US012742322B2

(12) United States Patent
Lonicek

(10) Patent No.: US 12,742,322 B2
(45) Date of Patent: Sep. 22, 2026

(54) LIQUID-COLLECTING ARRANGEMENT, LIQUID DRAINAGE SYSTEM AND METHOD FOR USE

(71) Applicant: ACO AHLMANN SE & CO. KG., Budelsdorf (DE)

(72) Inventor: Jiri Lonicek, Zdar nad Sazavou (CZ)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 181 days.

(21) Appl. No.: 18/256,373

(22) PCT Filed: Dec. 9, 2021

(86) PCT No.: PCT/EP2021/085034
§ 371 (c)(1),
(2) Date: Jun. 7, 2023

(87) PCT Pub. No.: WO2022/122944
PCT Pub. Date: Jun. 16, 2022

(65) Prior Publication Data

US 2024/0018768 A1 Jan. 18, 2024

(30) Foreign Application Priority Data

Dec. 9, 2020 (DE) ..... 10 2020 132 820.6

(51) Int. Cl.
*E03F 1/00* (2006.01)

(52) U.S. Cl.
CPC ..... *E03F 1/007* (2013.01)

(58) Field of Classification Search
CPC ..... E03F 1/007; E03F 1/006; E03F 5/10
See application file for complete search history.

(56) References Cited

U.S. PATENT DOCUMENTS 3,686,693 A 8/1972 Liljendahl
5,064,314 A 11/1991 Grooms
(Continued)

FOREIGN PATENT DOCUMENTS

CN 110431367 A 11/2019
DE 60123882 T2 2/2007
(Continued)

OTHER PUBLICATIONS

GB 2514682 A Translation (Year: 2014).*
(Continued)

*Primary Examiner* — Jerry-Daryl Fletcher
*Assistant Examiner* — Dario Antonio Deleon
(74) *Attorney, Agent, or Firm* — Chrisman Gallo Tochtrop LLC

(57) ABSTRACT

According to various embodiments, a liquid collecting arrangement (151) can include: a container (102) having a cavity (102*h*) for collecting liquid; at least one extraction fitting (104) coupled to the cavity (102*h*) for extracting the liquid from the cavity (102*h*) by means of negative pressure; a sensor opening (106) connected to the cavity (102*h*) for detecting the liquid in the cavity (102*h*); one or more first liquid feeds (108) opening into the cavity (102*h*) on a first side (101*a*) of the container for feeding liquid into the cavity (102*h*); one or more second liquid feeds (118) opening into the cavity (102*h*) on the first side or a second side (101*b*) of the container for feeding liquid into the cavity (102*h*), wherein the first side (101*a*) is opposite to the second side (101*b*).

16 Claims, 22 Drawing Sheets

(56) References Cited

U.S. PATENT DOCUMENTS

Figure 1:
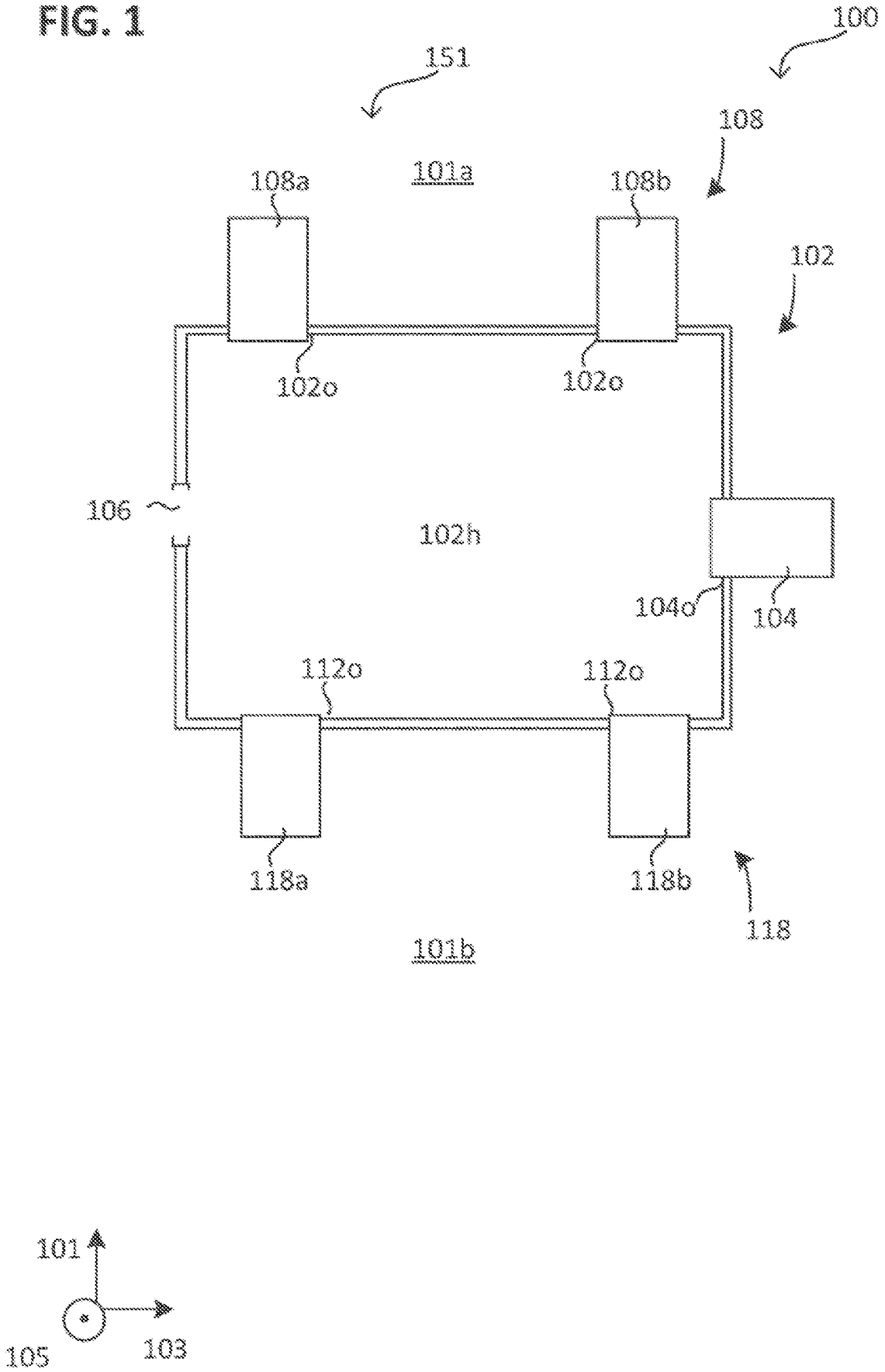

| | | | | |
|---|---|---|---|---|
| 6,772,789 | B1 | 8/2004 | Terry et al. | |
| 2010/0065131 | A1* | 3/2010 | Grooms | E03F 1/007 137/205 |
| 2019/0071852 | A1 | 3/2019 | Zinn et al. | |
| 2020/0191466 | A1 | 6/2020 | Cho et al. | |

FOREIGN PATENT DOCUMENTS

| | | | | | |
|---|---|---|---|---|---|
| EP | 0994989 | B1 | | 2/2005 | |
| FR | 2663058 | A1 | * | 12/1991 | E02D 29/12 |
| GB | 2514682 | A | * | 12/2014 | F04B 39/121 |
| JP | 2000144868 | A | | 5/2000 | |
| JP | 2002327489 | A | | 11/2002 | |
| KR | 20090105045 | A | * | 10/2009 | E03F 5/14 |
| KR | 20120052493 | A | * | 5/2012 | E03C 1/28 |
| KR | 101847554 | B1 | * | 4/2018 | E03F 5/041 |

OTHER PUBLICATIONS

FR 2663058 A1 Translation (Year: 1991).*
KR 101847554 B1 Translation (Year: 2018).*
KR 20090105045 A Translation (Year: 2009).*
KR 20120052493 A Translation (Year: 2012).*
Office Action issued in corresponding Korean Patent Application No. 2023-7022276; Dated: Oct. 30, 2024.
International Search Report issued in corresponding International PCT Application No. PCT/EP2021/085034; Mailing Date: Mar. 11, 2022.
Office Action issued in German Application No. 10 2020 132 820.6; Mailing Date: Mar. 13, 2021.
Search Report issued in corresponding Chinese Patent Application No. 202180089538.2; Dated; May 9, 2025.
Office Action issued in corresponding Chinese Patent Application No. 202180089538.2; Dated; May 9, 2025.

* cited by examiner

LIQUID-COLLECTING ARRANGEMENT, LIQUID DRAINAGE SYSTEM AND METHOD FOR USE

Various exemplary embodiments relate to a liquid-collecting system, a liquid drainage system, and a method for use In principle, there are devices that regularly and/or continuously dispense liquid (also generally referred to as a liquid source), the operation of which within buildings requires a separate disposal infrastructure for disposing of the liquid. For example, refrigeration units in supermarkets can produce condensed water that is drained off by means of the disposal infrastructure. Traditionally, the disposal infrastructure includes a pipe system buried in the ground, by means of which the liquid is drained.

According to various embodiments, a liquid-collecting arrangement, a liquid drainage system, and methods for use are provided that simplify the disposal infrastructure so that it is less complex and thus less expensive, easier to assemble, and serves a wider range of applications.

Clearly, the liquid-collecting arrangement provided herein means that an existing disposal infrastructure can be retrofitted or converted more easily and the disposal infrastructure can be reconfigured more easily or it is possible to react to a change in the requirements for the disposal infrastructure with less effort. For example, the liquid-collecting arrangement can make it easier to construct a disposal infrastructure if there is no pipe system in the around, if the pipe system does not match the positions of the liquid sources (for example refrigeration units), or if the premises are to be changed more frequently.

For example, supermarkets and other shops (retail) are moving towards renting their premises. However, if these are not pre-equipped with a matching disposal infrastructure, an expensive modification would have to be carried out, which can be averted by means of the liquid-collecting arrangement.

As explained above, the liquid-collecting arrangement makes it possible to simplify the disposal infrastructure. For example, the liquid-collecting arrangement can make it possible to reduce the liquid-draining pipelines per liquid source (for example refrigeration unit). For example, the liquid-collecting arrangement can make it possible to dispense with buried collecting containers and their complex cleaning. For example, the liquid-collecting arrangement can make it possible to require fewer assembly steps per liquid source.

Clearly, the liquid-collecting arrangement has a large number of connection options, so that it is easier to assemble and/or can serve a larger or variable range of applications. The liquid-collecting arrangement has multiple liquid feeds on each of both sides, so that it can be connected to more liquid sources or to variably positioned liquid sources without increasing the assembly effort. For example, an additional liquid source can be connected to the existing liquid-collecting arrangement with less effort, or this liquid source can also be disconnected from it again if this is desired. This means that liquid sources can be exchanged more easily or the number of them can be changed without much effort.

In the figures

Figure 15:
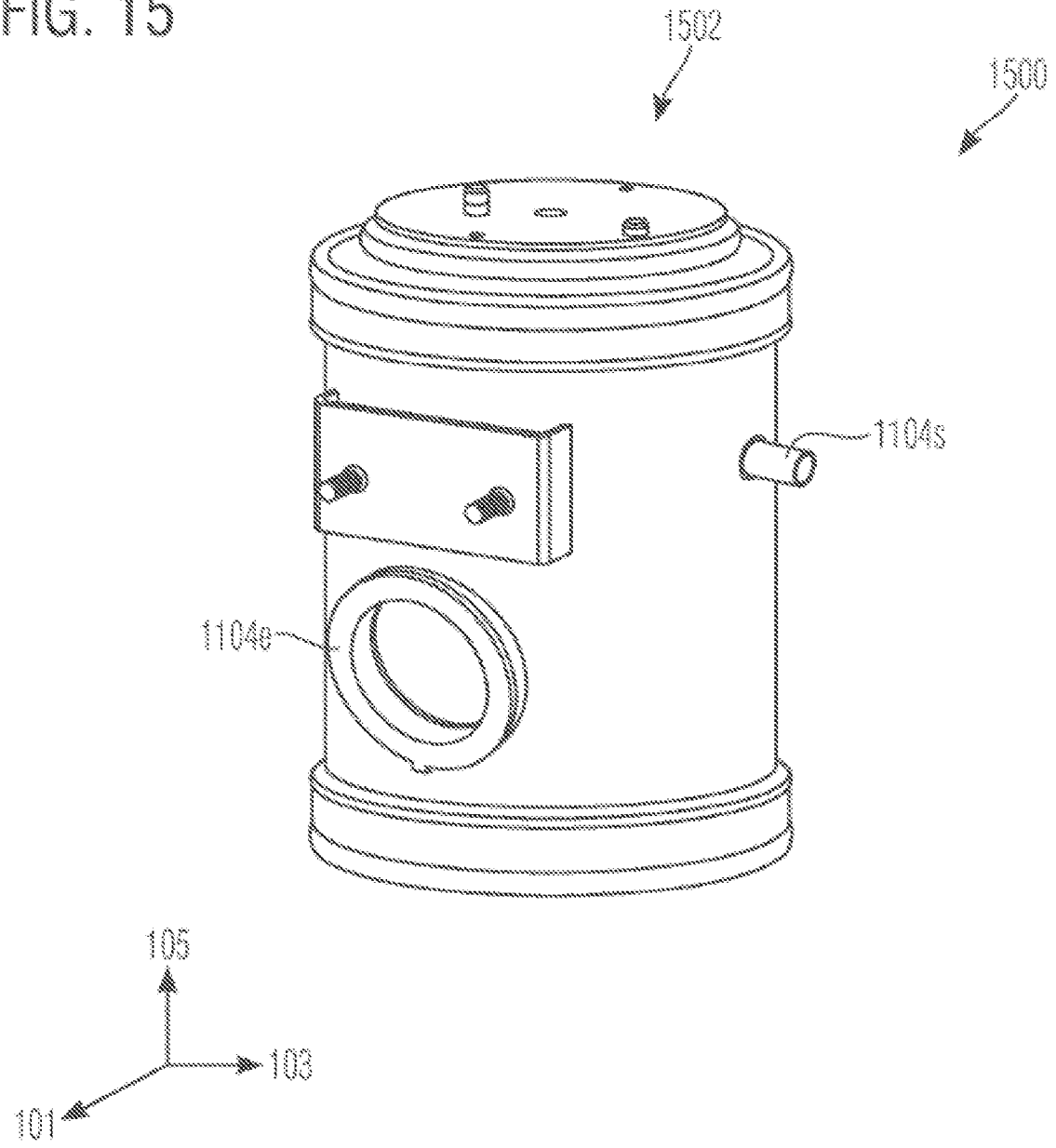
Figure 16:
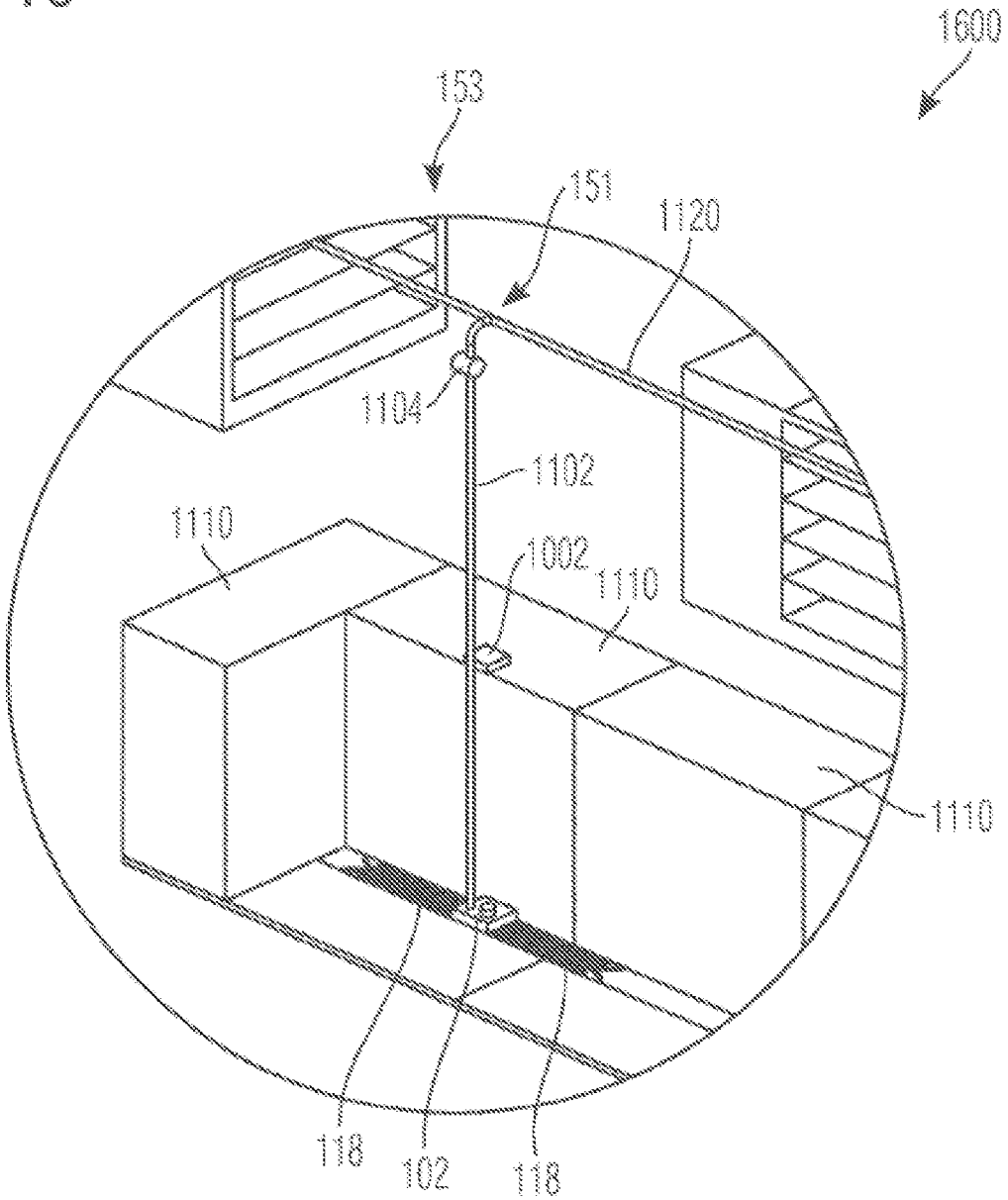
Figure 17:
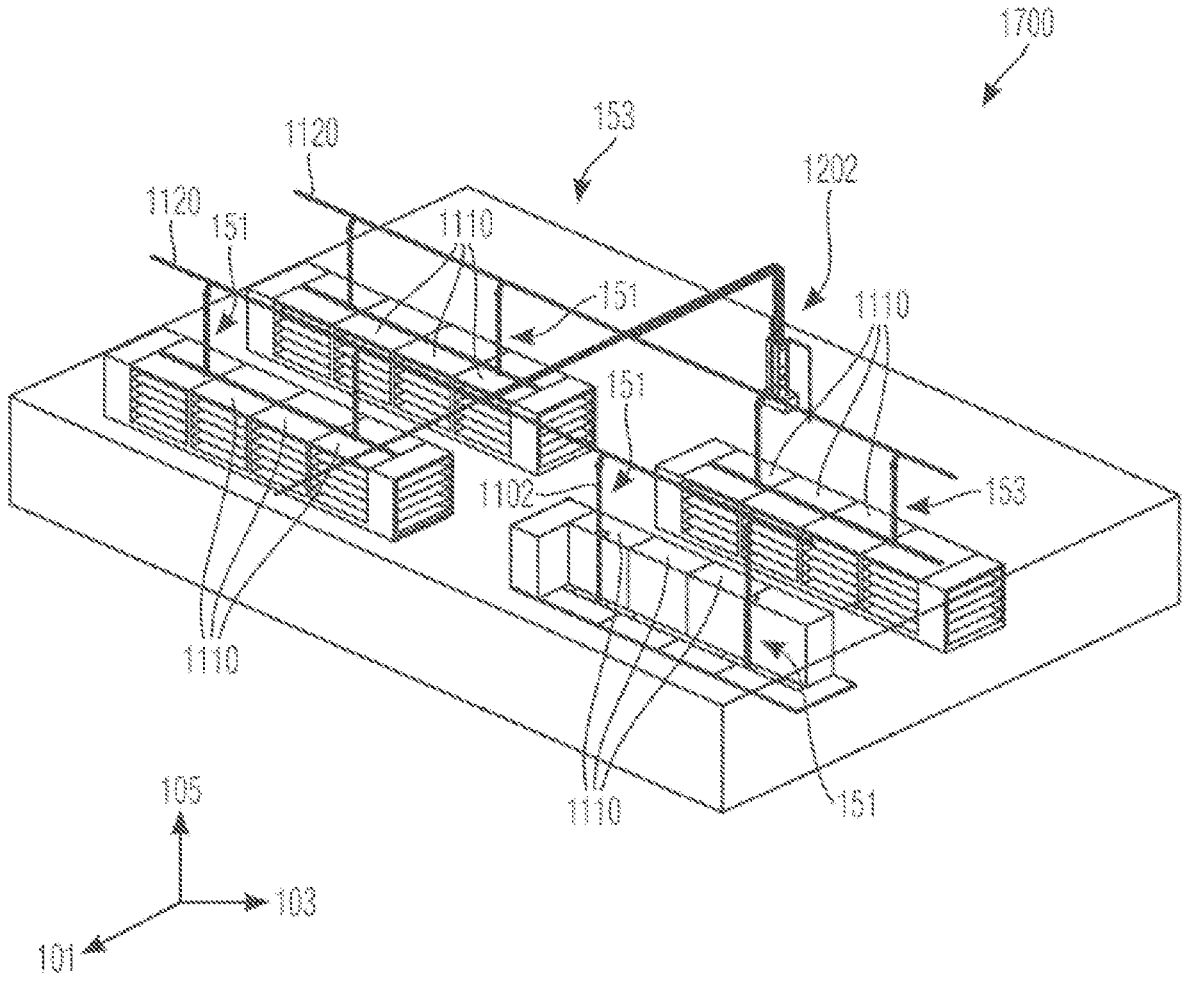
Figure 18:
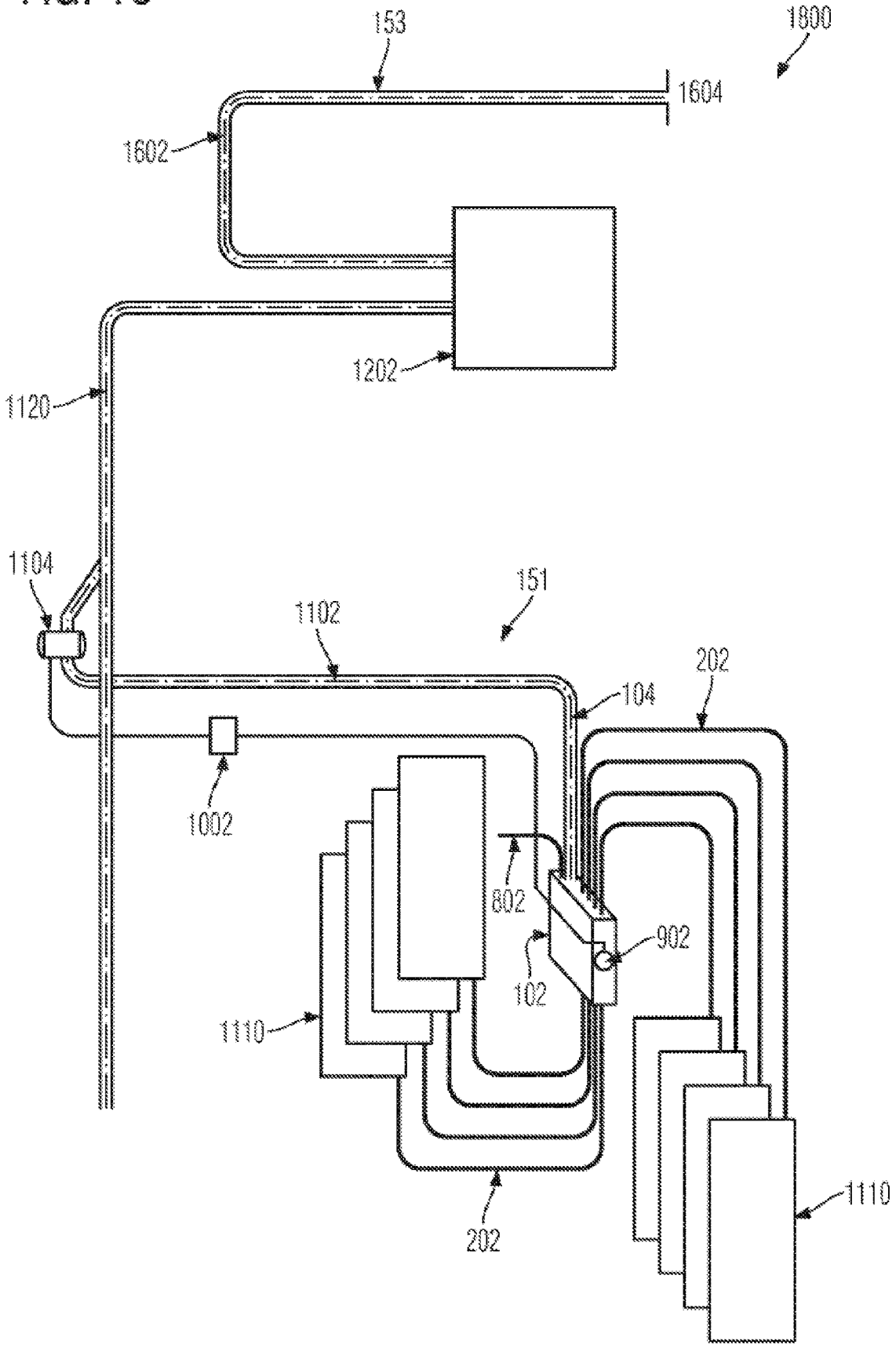
Figure 19:
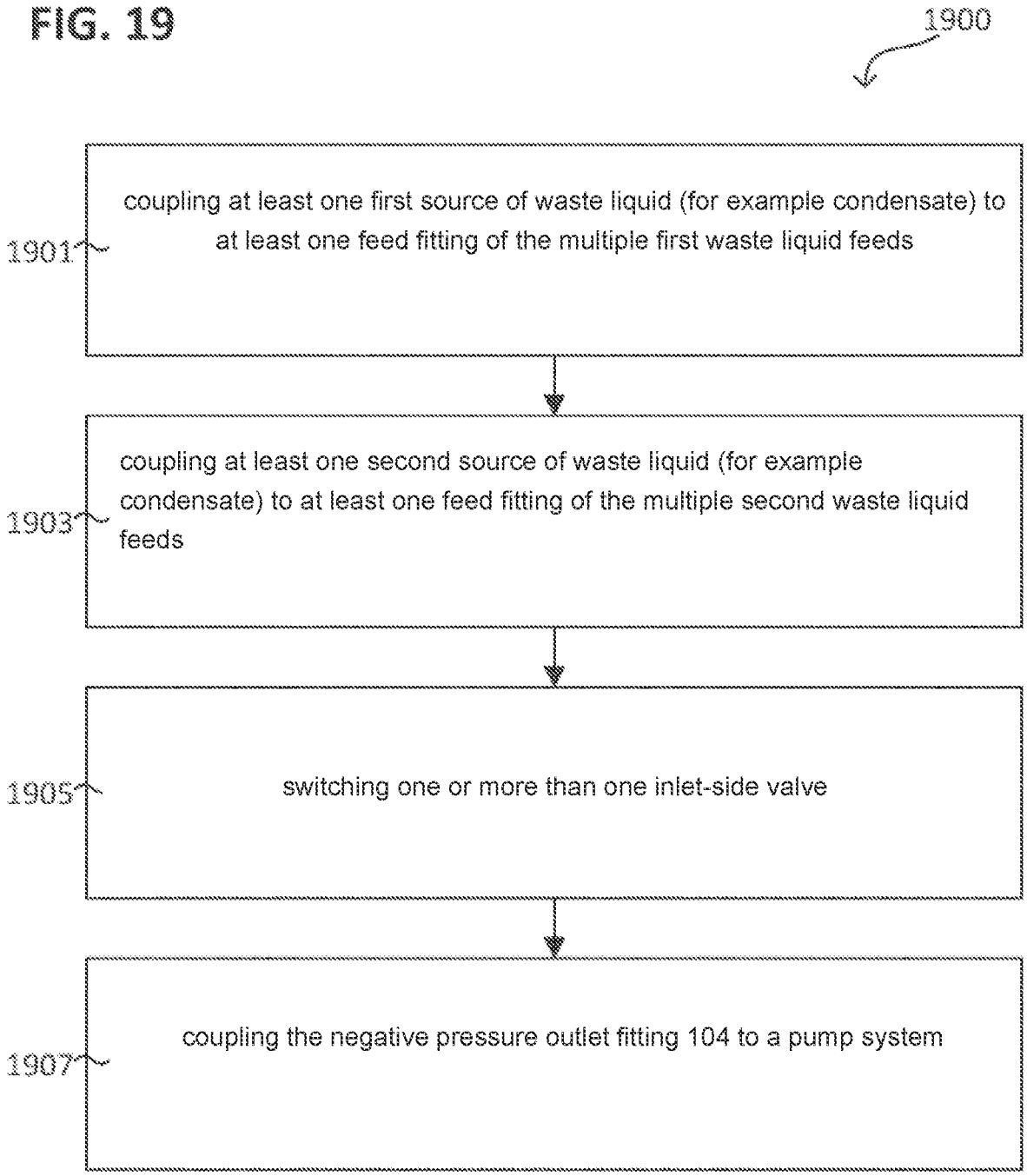
Figure 20:
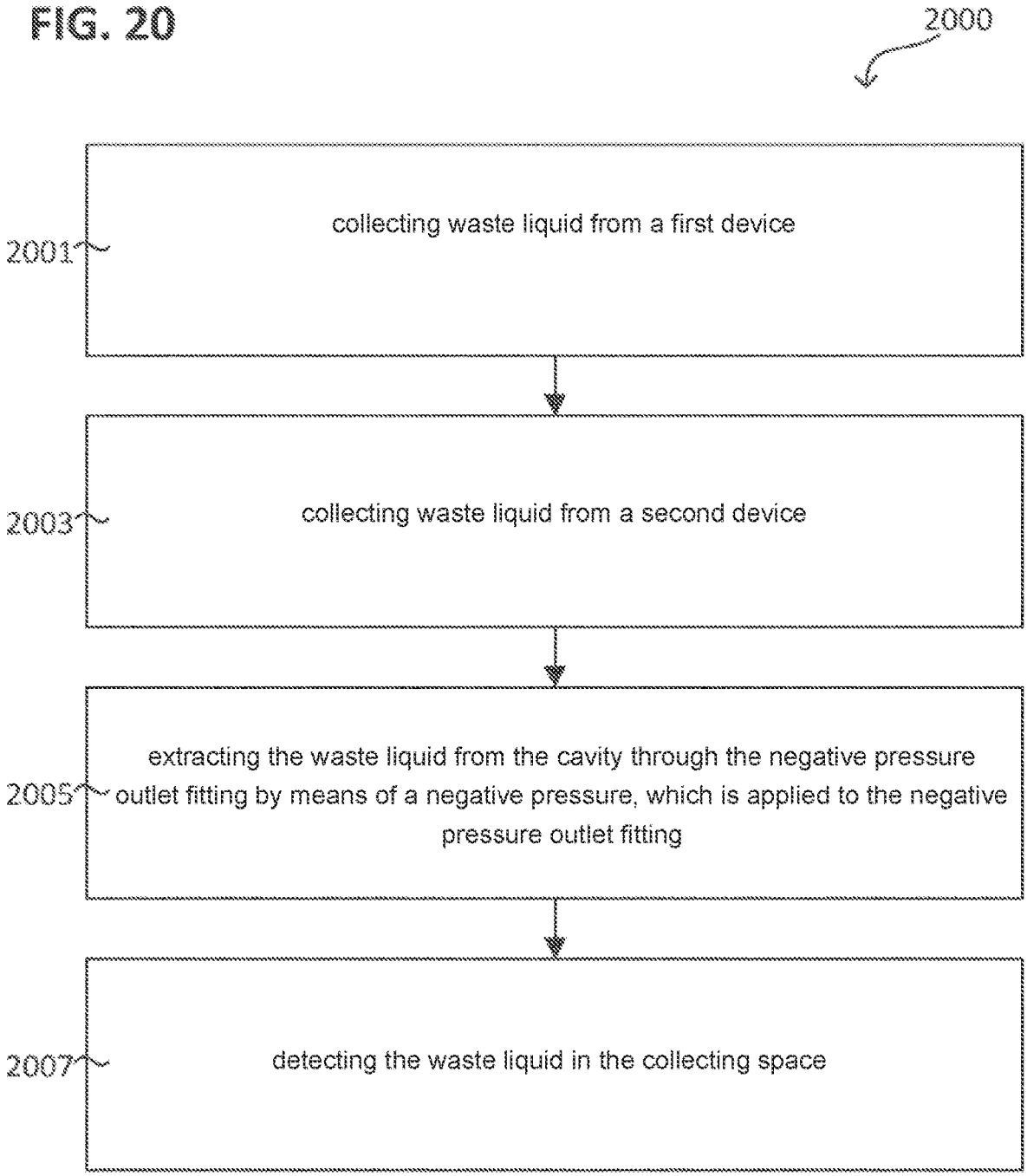
Figure 21:
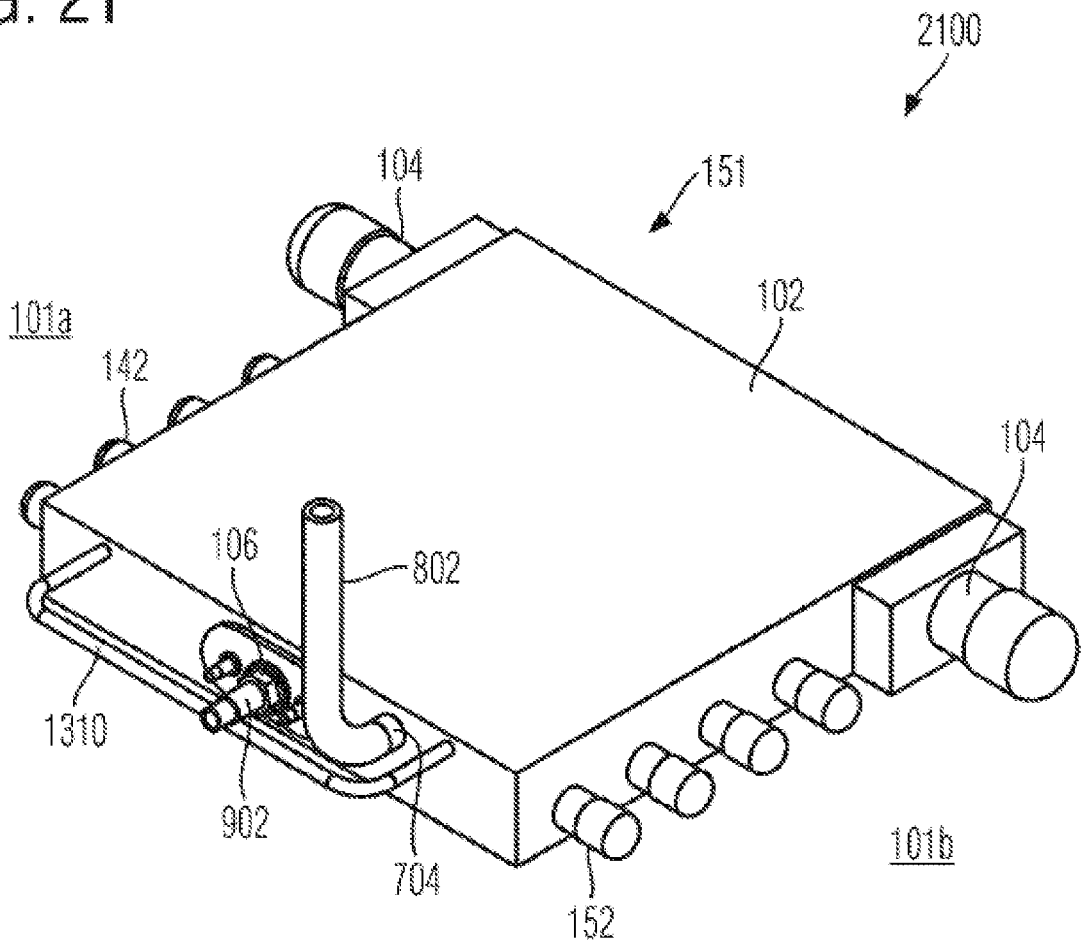
Figure 22A:
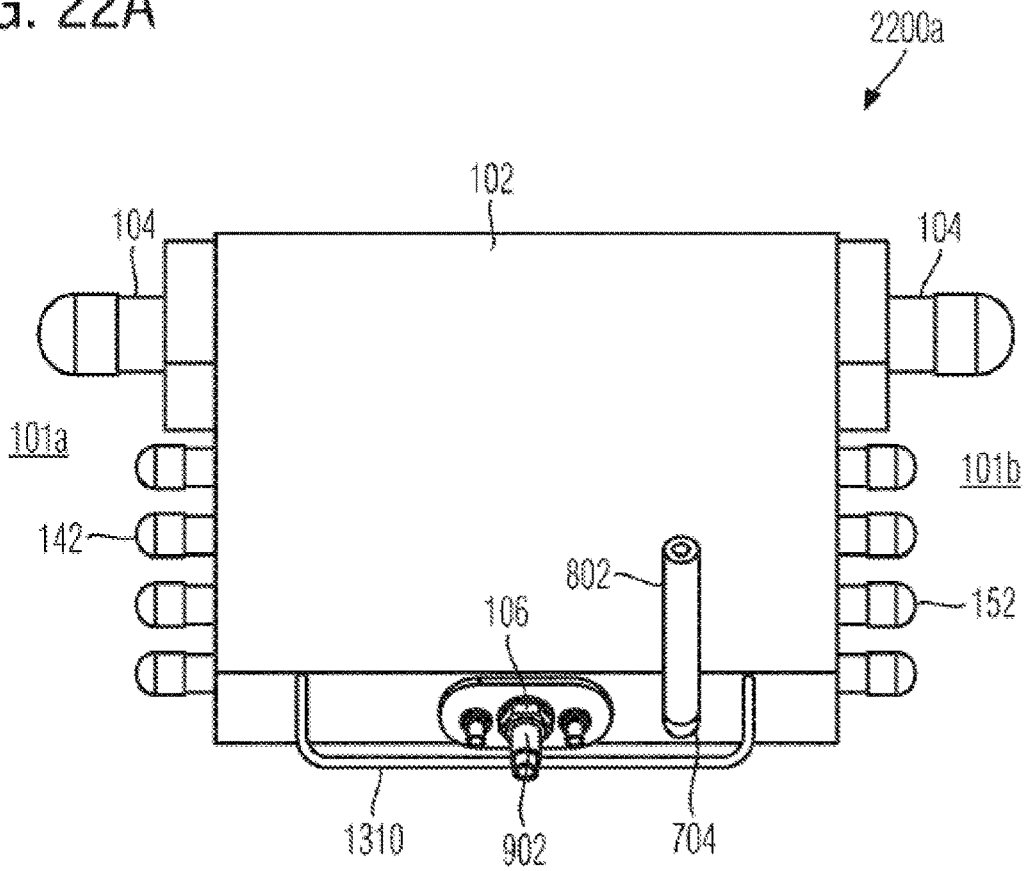
Figure 22B:
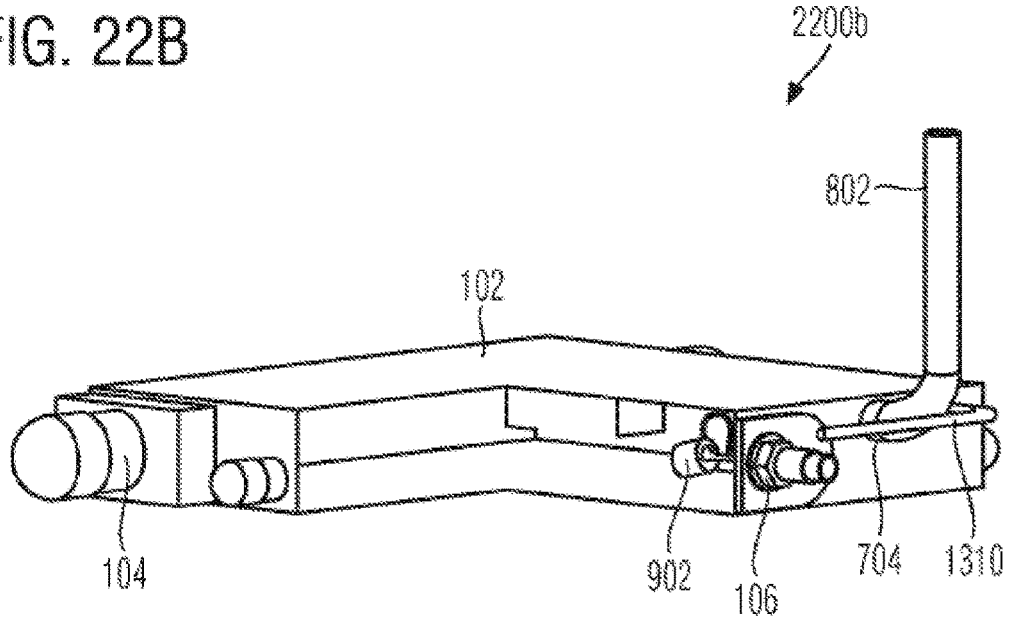

FIGS. 1 to 14 each show a liquid-collecting arrangement according to different embodiments in different schematic views;

FIG. 15 shows an actuator of the liquid-collecting arrangement according to different embodiments in a schematic perspective view;

FIGS. 16 to 18 each show a liquid drainage system according to different embodiments in a schematic perspective view;

FIGS. 19 and 20 each show a method according to different embodiments in a schematic flow chart; and FIGS. 21, 22A, and 22B each show a liquid-collecting arrangement according to different embodiments in different schematic views.

In the following detailed description, reference is made to the accompanying drawings that form a part hereof, and in which specific embodiments in which the invention can be implemented are shown for illustration. In this regard, directional terminology such as "above", "below", "front", "back", "front", "rear", etc. is used with reference to the orientation of the described figure(s). Because components of embodiments can be positioned in a number of different orientations, the directional terminology is used for purposes of illustration and is in no way restrictive. It is understood that other embodiments can be utilized and structural or logical changes can be made without departing from the scope of the present invention. It is understood that the features of the various exemplary embodiments described herein can be combined with one another unless specifically stated otherwise. The following detailed description is therefore not to be interpreted in a restrictive sense, and the scope of protection of the present invention is defined by the appended claims.

Within the scope of this description, the terms "connected", "attached", and "coupled" are used to describe both a direct and an indirect connection (for example electrically conductive and/or fluidic connection), a direct or indirect attachment, and a direct or indirect coupling. In the figures, identical or similar elements are provided with identical reference signs, insofar as this is appropriate.

According to various embodiments, the term "coupled" or "coupling" can be understood in the sense of a (e.g., mechanical, hydrostatic, thermal, and/or electrical), for example direct or indirect, connection and/or interaction. For example, multiple elements can be coupled to one another along an interaction chain, along which the interaction can be exchanged, for example a fluid (then also referred to as fluidically coupled or hydrostatically coupled). For example, two elements coupled to one another can exchange an interaction with one another, e.g., a mechanical, hydrostatic, thermal, and/or electrical interaction. Multiple components of a hydrostatic composite (e.g., fittings, valves, pumps, lines, containers, hoses, etc.) can be coupled to one another in order to exchange a fluid. Their coupling to one another can include that they are fluidically coupled to one another. According to various embodiments, "coupled" can be understood in the sense of a mechanical (for example physical) coupling, for example by means of a direct physical contact.

In principle, a line can include a hollow body that is open on both sides. The line can, for example, be configured rigidly (for example including a pipe) or configured flexibly (for example including a hose). A rigid line (for example a pipe) can, for example, be so rigid that it can bridge a distance of more than 5 times (for example 10 times or 20 times) the circumference of the line in a freely cantilevered manner. A flexible line (for example a hose) can, for example, be so flexible that it can be reversibly curved (for example under the influence of its own weight), for example along an arc of a circle whose diameter is less than 10 times (for example 5 times) the circumference of the line.

Controlling can be understood as intentional influencing of a present state, for example the state of an entity (for example a device, a system, or a process). The present state of the entity (also referred to as the actual state) can be changed according to a specification (also referred to as the target state). Regulation can be understood as controlling, wherein a state change due to disturbances is also counteracted. Clearly, the controller can have a forward-directed controlled system and thus can clearly implement a sequence control which converts an input variable (for example the specification) into an output variable. However, the controlled system can also be part of a control loop, so that a regulation is implemented. In contrast to the purely forward-oriented sequence control, regulation has a continuous influence of the output variable on the input variable, which is caused by the control loop (also referred to as feedback). In other words, regulation can be used alternatively or additionally to the control, or regulation can take place alternatively or additionally to the control. In a control loop, the measuring element (also referred to as a sensor), control element (also referred to as a control device), and actuator form an interaction chain of the control loop whose end points are connected to one another by the entity to be influenced to form the control loop.

The term "actuator" can be understood as a physical component that is configured to influence the actual state in that an actuation of the actuator takes place. The actuator can convert instructions of both by the control device (the so-called actuation) into mechanical movements or changes in physical variables, such as pressure, force, or flow rate. The actuator, for example an electromechanical converter, can be configured, for example, in response to actuation to convert electrical energy into mechanical energy (for example by movement), to eliminate or establish a fluidic connection, etc. The actuator can include a drive device (also referred to as an actuator). Examples of an actuator include: an electric motor, an automatic valve (or other fluid-mechanical switch), a pump, or the like. Examples of the drive device include: a motor, a magnetic drive, a piezoelectric drive, a reciprocating piston, or the like. The motor or the drive device can be, for example, a linear motor or a rotary motor. The linear motor can be configured, for example, to generate and output a linear movement. The drive device (for example the linear motor) can include a magnetic coil (for example a cylinder coil), for example.

The term "control device" can be understood as any type of logic-implementing entity, which can include, for example, a processor (and, for example, corresponding circuitry), which can, for example, execute software stored in a storage medium, in firmware, or in a combination thereof, and can output instructions based thereon. The control device (for example implementing a control loop) can be configured to implement one or more than one of the processes described herein. The control device can include, for example, a programmable logic controller (PLC) or can be formed therefrom.

A waste liquid is referred to herein as an exemplary fluid. It can be understood that what has been described for the waste liquid can apply by analogy to any other (for example condensed) fluid (for example including or consisting of a liquid). The waste liquid can include or consist of an organic liquid, for example. The waste liquid can include or consist of an inorganic liquid, for example. Examples of the waste liquid include: waste water, condensed water, coolant liquid, oil, etc. Waste water can clearly include contaminated water, for example including suspended matter or other solid matter, including a liquid other than water, including dissolved components. Condensed water is water that condenses on a cool surface of objects as soon as water-containing air or gas is cooled below the dew point there. If the moisture condenses from water-containing air, the condensed water can also contain condensable air impurities. What has been described with regard to the waste liquid can, for example, apply by analogy to any direct vacuum drainage from one or more than one device that produces or at least has a liquid to be discharged (also referred to as a liquid source).

According to various embodiments, the exchange (for example transport) of a fluid (for example a liquid, for example the waste liquid) is excited or effectuated by means of a pressure differential (also referred to as extraction). Due to the extraction, the fluid can be withdrawn efficiently and against the force of gravity and/or over a longer distance, for example remotely. For example, the pump system used for extraction can be arranged at a greater distance from the location of the waste liquid-collecting arrangement.

Extraction can include subjecting the fluid to the pressure differential (for example, between a negative pressure and atmospheric air pressure). The pressure differential can be, for example, greater than approximately 0.1 bar, for example approximately 0.25 bar, for example approximately 0.5 bar, for example approximately 0.75 bar, for example approximately 0.9 bar. The application of the pressure differential to the fluid can include, for example, subjecting the fluid to the negative pressure (for example, a vacuum). The negative pressure can be less than the atmospheric air pressure. The negative pressure can be generated, for example, by means of a pump system. The negative pressure can be less than approximately 0.8 bar, for example approximately 0.7 bar, for example approximately 0.6 bar. The vacuum can be less than approximately 0.3 bar, for example approximately 0.2 bar, for example approximately 0.1 bar. The fluid can be exposed to atmospheric air pressure by means of a so-called ventilation opening. The extraction can include transporting the fluid toward the negative pressure and away from the atmospheric air pressure.

Reference is made here to various components (e.g., fittings, pumps, lines, containers, hoses, etc.) of a hydrostatic compound, which can optionally be configured to be suitable for negative pressure (then also referred to as negative pressure component). A negative pressure component (e.g., negative pressure line, negative pressure hose, negative pressure connection, negative pressure container, etc.) can clearly be set up to be negative pressure-stable (for example vacuum-stable), i.e. it can withstand a negative pressure in the interior during external application of the atmospheric air pressure (also referred to as pressure-stable), for example essentially without deformation and/or while maintaining its fluid-conducting capabilities, and/or separate them from each other airtight. This ensures that the negative pressure component is still fluid-conducting when a negative pressure is applied thereto, so that extraction can take place through it. A negative pressure fitting can include a seal, for example.

According to various embodiments, a negative hose (for example vacuum hose), a negative pressure pipe, or a negative pressure line (for example vacuum line) can be designed to be dimensionally stable in such a way that it withstands the effects of atmospheric air pressure in the pumped-out state. A pump system (including at least one vacuum pump and/or one liquid pump) can make it possible to pump part of the gas out of the interior of the waste liquid-collecting arrangement, for example out of its collecting space.

Reference is also made herein to fittings (for example, feed fitting or outlet fitting). A fitting can be configured to be coupled to another component (for example, to form a hydrostatic composite), for example, to another fitting and/or to a device that dispenses and/or receives a fluid. For this purpose, the connection can include one or more than one form-fitting contour. Examples of a form-fitting contour include: eyelet, thread, through-opening, depression or latching lug (for example of a latching closure), longitudinal slot (for example of a bayonet closure), projection (for example of the bayonet closure), etc. For example, the fitting can include a flange or be formed therefrom.

According to various embodiments, a possibility for connecting cooling/freezing units to a vacuum drainage system and a possibility for discharge condensate from the cooling/freezing units is provided. The connection is established by means of a collecting container having one or more inlets and outlets and flexible hoses, wherein one end is connected to a condensate outlet in the cooling/freezing units and the other end is connected to the collecting container. The condensate can flow freely from the refrigerating/freezing units via hoses to the collecting container. When the collecting container is full, a level switch in the collecting container gives a signal to drain the collecting container and to extract the condensate, for example from the hoses. Then the process repeats itself.

The advantage of this configuration is, among other things, that multiple refrigerating/freezing units (for example up to 8 units) can be connected to one interface/lifting unit, which minimizes costs and is less visually disturbing (for example by reducing the number of vertical lifting pipes). This is particularly important in large supermarkets. Other advantages include that the system is closed, emits less odor, is self-cleaning, flexible, and easy to install, can provide different length of hoses, can enable variable position of the collecting container.

FIG. 1 illustrates a waste liquid-collecting arrangement 151 according to various embodiments 100 in a schematic top view or cross-sectional view. The waste liquid collecting arrangement 151 includes a container 102 (also referred to as a collecting container 102) which includes a cavity (also referred to as a reservoir, collecting space, or cavity) 102*h*. The container 102 can include, for example, a container housing (clearly a hollow body), the interior of which provides the collecting space 102*h*. The waste liquid-collecting arrangement 151 also includes at least one extraction fitting 104 (also referred to as a negative pressure outlet fitting), which is coupled to the collecting space 102*h*, for example opens into it.

Optionally, the at least one extraction fitting 104 (also referred to as an outlet fitting) can include multiple extraction fittings (not shown, also designated as left extraction fitting 104 and right extraction fitting 104), which are arranged, for example, on opposite sides of the container 102 and/or extend away from one another. This facilitates the assembly of the waste liquid-collecting arrangement 151. In the following, reference is made to an extraction fitting 104 as an example, which is used to extract the waste liquid. In the case of multiple extraction fittings, example, each extraction fitting of the waste liquid-collecting arrangement 151 that is different from the extraction fitting 104 and that is not to be used for suction (then also referred to as an inactive extraction fitting) can be reversibly closed.

The waste liquid collecting arrangement 151, for example the container housing, furthermore includes a sensor opening 106 which is connected to the collecting space 102*h*, for example opens therein. Optionally, a liquid sensor can be or become arranged in the sensor opening 106, as will be described later in more detail. The liquid sensor can be configured to detect the waste liquid in the collecting space 102*h*. Optionally, an inactive extraction fitting (if present) or the corresponding opening in the container 102 can be used as the sensor opening 106.

The waste liquid-collecting arrangement 151 also includes a large number of waste liquid feeds 108, 118, for example four or more waste liquid feeds. The large number of waste liquid feeds includes multiple first waste liquid feeds 108, which include a first waste liquid feed 108*a*, an additional first waste liquid feed 108*b*, and optionally also one or more than one additional first waste liquid feed (not shown). The large number of waste liquid feeds furthermore includes multiple second waste liquid feeds 118, which include a second waste liquid feed 108*a* and an additional second waste liquid feed 108*b*, and optionally also one or more than one additional second waste liquid feed (not shown). For example, a number of waste liquid feeds per side 101*a*, 101*b* can be more than 2, more than 3, or more than 4.

The multiple first waste liquid feeds 108 and the multiple second waste liquid feeds 118 can, for example, open into the collecting space 102*h* on opposite sides (also referred to as first side 101*a* and second side 102*b*) of the container 102 (for example through its container housing).

The container 102 (for example its container body) can include multiple first openings 102*o* (also referred to as first container openings or inlet openings) on the first side 101*a* (also referred to as the first lateral side), of which each first opening 102*o* is coupled to or receives a waste liquid feed of the multiple waste liquid feeds (for example, of the multiple first waste liquid feeds 108). The openings 102*o* can be provided, for example, by means of corresponding fittings (also referred to as inlet nozzles or inlet fittings) of the container 102. For example, each inlet fitting can include a protruding pipe stub.

The container 102 (for example its container housing) can include multiple second openings 112*o* (also referred to as second container openings or inlet openings) on the second side 101*b* (also referred to as the second lateral side), of which each second opening 112*o* is coupled to or receives a waste liquid feed of the multiple waste liquid feeds (for example, of the multiple second waste liquid feeds 118).

This two-sided opening of waste liquid feeds into the collecting space 102*h* facilitates the connection of the waste liquid collecting arrangement 151 to devices that discharge waste liquid (also referred to as a source for waste liquid or as a liquid source in short). Clearly, due to the two-sided opening, less complex fluid guidance is required, the transport routes can be shorter, and the assembly can be facilitated.

Reference is made herein by way of example, and in particular below by way of example, to one waste liquid feed of the plurality of waste liquid feeds (for example of the plurality of first waste liquid feeds 108 and/or of the plurality of second waste liquid feeds 118). It can be understood that what is described for the exemplary waste liquid feed applies by analogy to more than one waste liquid feed of the plurality of waste liquid feeds (for example of the multiple first waste liquid feeds 108 and/or of the multiple second waste liquid feeds 118), for example for each waste liquid feed of the multiple first waste liquid feeds 108 and/or of the multiple second waste liquid feeds 118.

The container 102 can include, for example, a lower side 801*b* (cf. FIG. 8) which, in the installed state, faces an underlying surface on which the waste liquid-collecting arrangement 151 stands, and an upper side 801*a* which faces away from the underlying surface. The first side 101*a* and the second side 102*b* of the container 102 can be different from the lower so 801*b* and different from the upper side 801*a*. This achieves the flattest possible construction of the container 102 so that it can be more easily placed under a source for waste liquid.

For example, a height (dimension from the upper side 801*a* to the lower side 801*b*) of the container 102 can be less than approximately 0.4 m (meters), for example approximately 0.3 m, for example approximately 0.2 m, for example approximately 0.1 m, for example approximately 0.05 m. This achieves the flattest possible construction of the container 102 so that it can be more easily placed under a source for waste liquid. Alternatively or additionally, the height of the container 102 can be less than a width of the container 102 (dimension from the first side 101*a* to the second side 101*b*) and/or a length of the container 102.

For example, a volume of the collecting space 102*h* can be in a range from approximately 0.5 L (liters) to approximately 15 liters ($dm^3$) or in a range from approximately 0.01 L (liters) to approximately 20 L, for example in a range of approximately 0.1 L to approximately 10 L. Alternatively or additionally, the volume of the collecting space 102*h* can be greater than approximately 0.5 L, for example, approximately 1 L, for example, approximately 2 L, for example, approximately 5 L. Alternatively or additionally, the volume of the collecting space 102*h* can be less than approximately 100 L, for example than approximately 50 L, for example approximately 20 L, for example approximately 10 L.

The waste liquid-collecting arrangement 151 can be or become arranged in a building, for example.

The container 102 (for example its container housing) can include a third opening 104*o* (for example laterally or on the upper side), which is coupled to the extraction fitting 104 or receives it. The mouth of the extraction fitting 104 can, for example, have the same height position as the bottom 102*b* of the container 102, which delimits the collecting space 102*h* towards the lower side 801*b*. This promotes the extraction of the waste liquid from the container 102. For example, the extraction fitting 104 can open out laterally (for example from direction 103) into the collecting space 102*h*. For example, the extraction fitting 104 can extend through the third opening 104*o* from above and into the collecting space 102*h* toward the bottom of the container 102.

Figure 2:
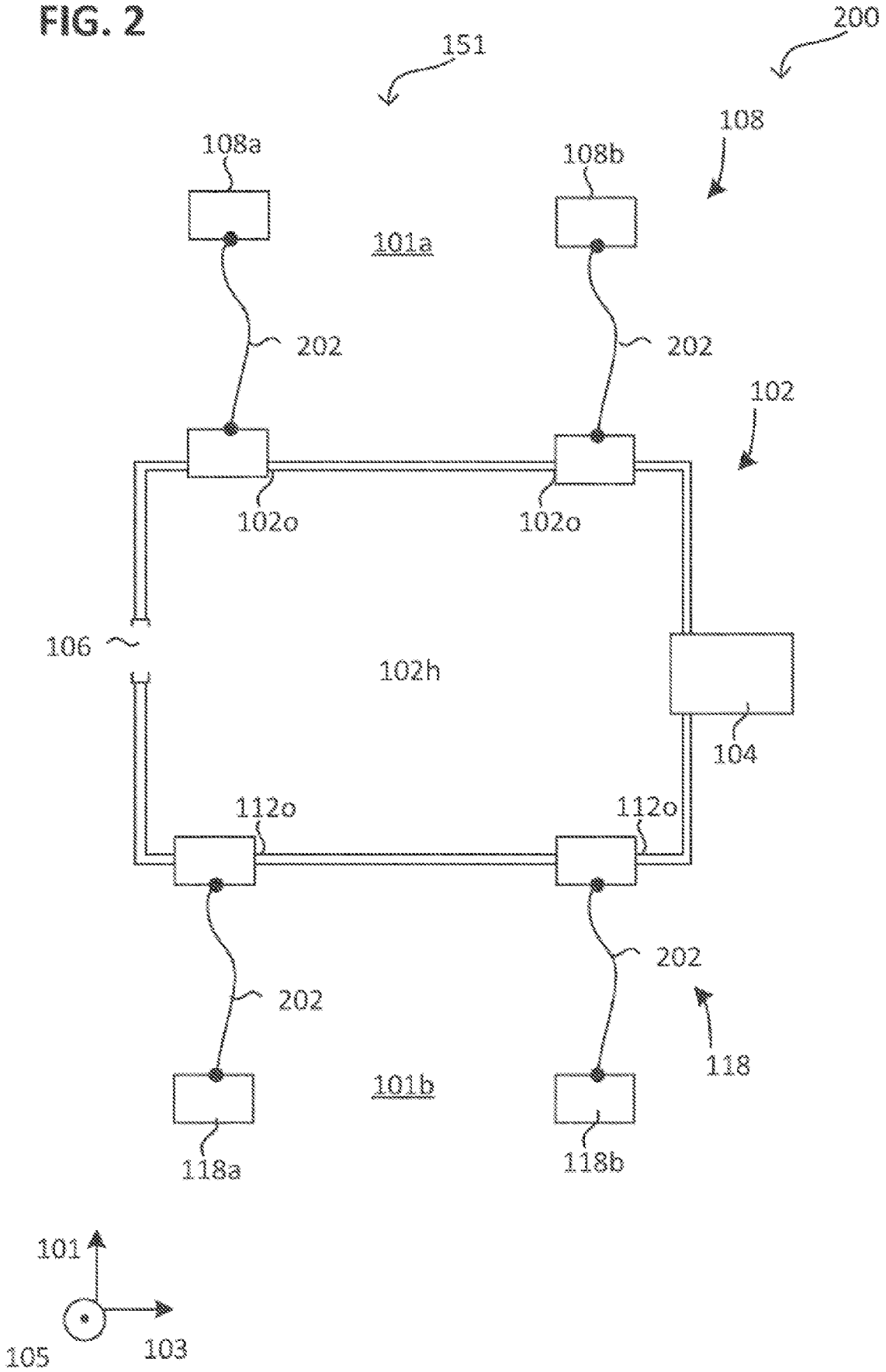

FIG. 2 illustrates a waste liquid-collecting arrangement 151 according to various embodiments 200 (for example configured according to the embodiments 100), in a schematic top view or cross-sectional view, in which the waste liquid feed includes a connecting line 202 (for example a hose 202) which is coupled to the container 102. Optionally, the connecting line 202 (for example the hose 202) can be configured as a negative pressure hose. A hose is referred to herein as an exemplary connecting line 202, among other things. What has been described for the hose can apply in analogy to any other connecting line 202, for example a pipe.

The hose 202 can include a flexible elongate hollow body, for example having a round cross section. In contrast to an inflexible line (for example a pipe), the hose can be deformed with little force and/or reversibly, for example even under the effect of its own weight. For example, the hose can adapt itself to the contour of an underlying surface on which the hose is arranged under the action of gravity alone. In order to provide the flexibility, the hose can be made of a suitable material or can be or become provided in a suitable shape. The hose 202 can, for example, include or consist of a polymer (for example an elastomer, for example rubber). The hose 202 can, for example, include or consist of fibers, for example a fabric or as a component of a composite material. For example, the hose 202 can include or consist of metal, for example, providing folds, corrugations, a fabric, and/or windings of the hose. Examples of the hose 202 include: a corrugated hose, a metal bellows, a fabric hose, a wound hose, a plastic hose.

The hose 202 further facilitates the connection of the waste liquid-collecting arrangement 151 to liquid sources. Clearly, due to the flexible property of the hose 202, less complex fluid guidance is required, the transport routes can be shorter, and the assembly can be facilitated.

The hose 202 can, for example, have a length (distance of the fluid-conducting connection between hose inlet and hose outlet) which is approximately 0.5 m (meters) or is greater than approximately 0.5 m (meters), for example approximately 1 m or greater than approximately 1 m, for example approximately 2 m or greater than approximately 2 m, for example approximately 3 m or greater than approximately 3 m, for example approximately 4 m or greater than approximately 4 m, for example approximately 5 m or greater than approximately 5 m, for example approximately 6 m or greater than approximately 6 m, for example approximately 7 m or greater than approximately 7 m. The longer the hose, the easier the assembly can be and the more variable the operable range of applications can be.

Figure 3:
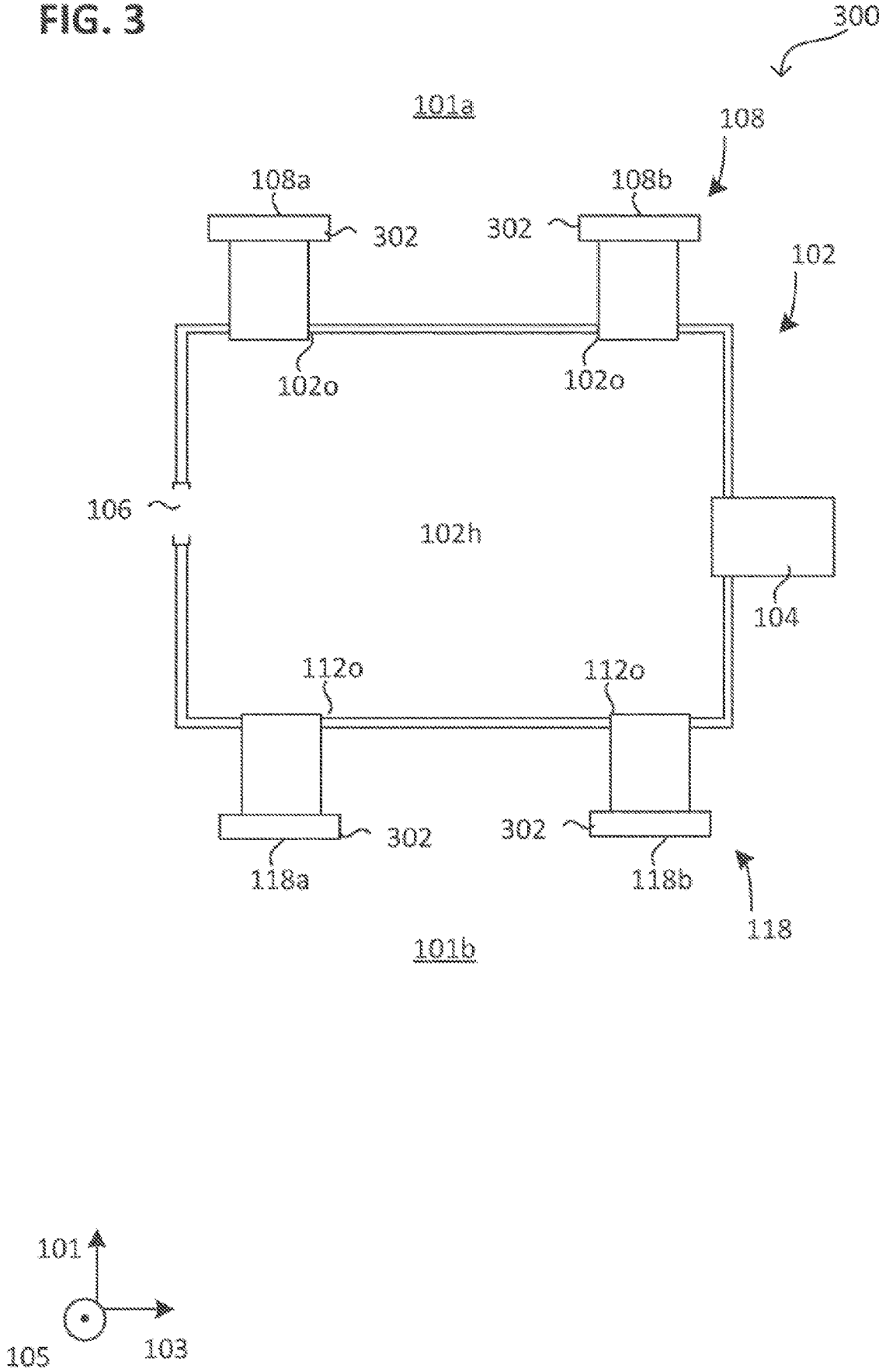

FIG. 3 illustrates a waste liquid-collecting arrangement 151 according to various embodiments 300 (for example configured according to the embodiments 100 or 200), in a schematic top view or cross-sectional view, in which the waste liquid feed includes a feed fitting 302 (also referred to as the inlet-side fluid fitting or inlet fitting) which is coupled to the container 102. The feed fitting 302 can be configured to be connected to another fitting or to a liquid source.

The feed fitting 302 further facilitates the connection of the waste liquid-collecting arrangement 151 to a liquid source. Clearly, a prefabricated and mutually compatible configuration can be provided, so that fewer assembly steps are necessary.

For example, the feed fitting 302 can include or be formed from a flange. The flange is a particularly easy to assemble and universal fitting type.

Figure 4:
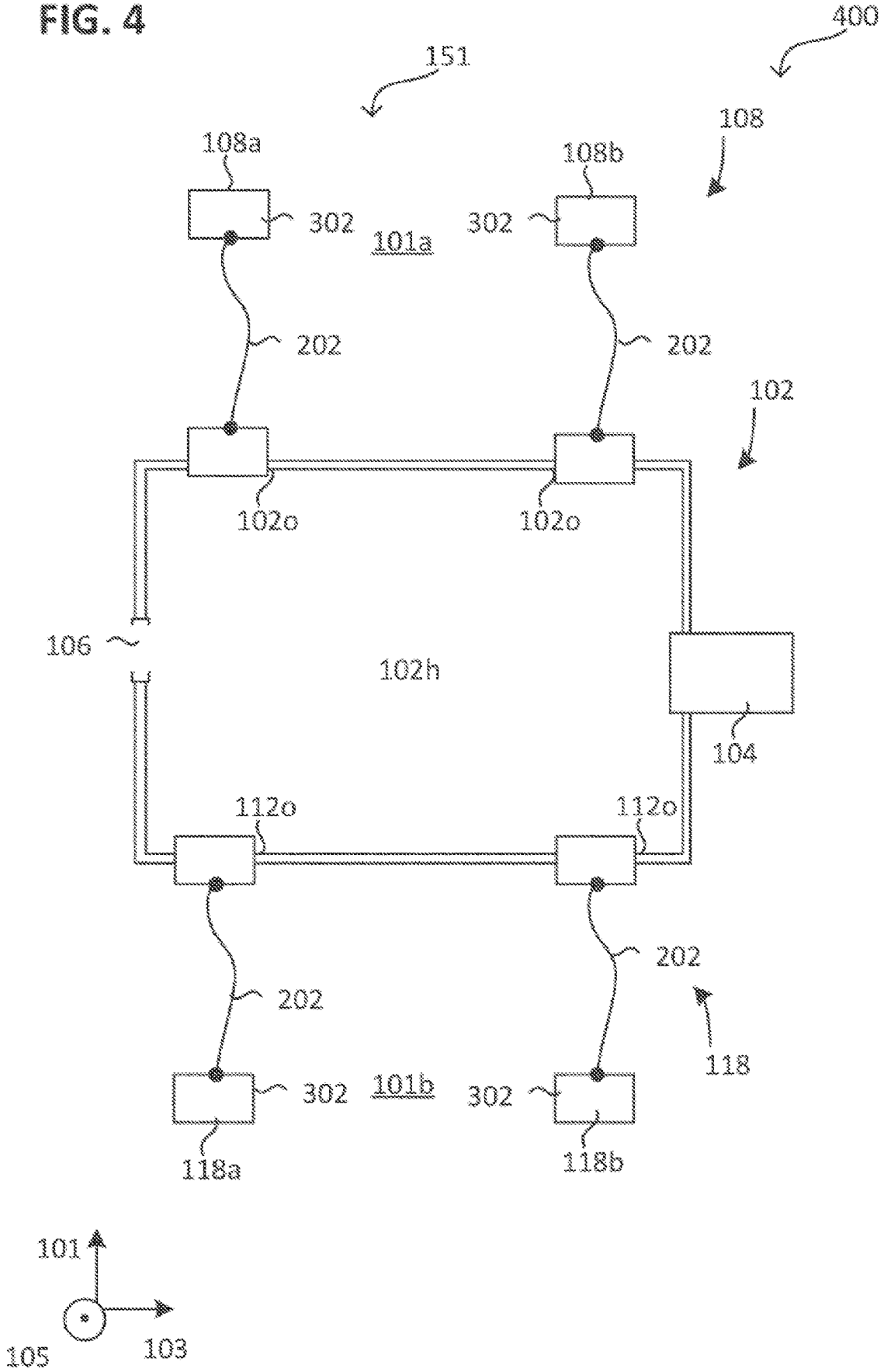

FIG. 4 illustrates a waste liquid-collecting arrangement 151 according to various embodiments 400 (for example configured according to the or several of the embodiments 100 to 300), in a schematic top view or cross-sectional view, in which each feed fitting 302 is coupled by means of a hose 202 to the container 102 (for example the corresponding opening 102*o*, 112*o*).

Figure 5:
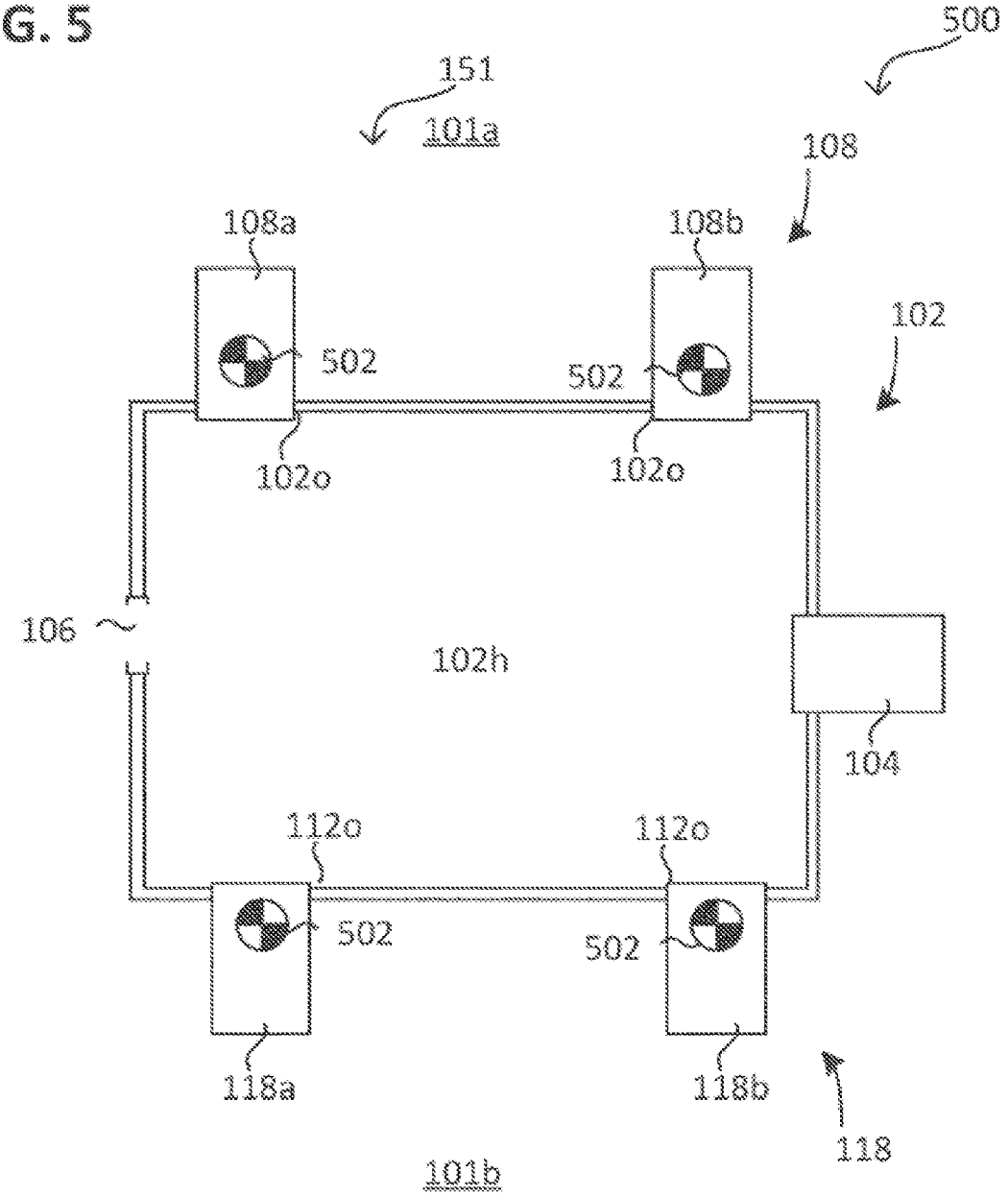
Figure 5:
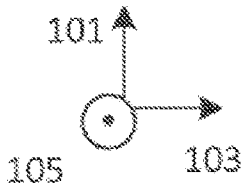

FIG. 5 illustrates a waste liquid-collecting arrangement 151 according to various embodiments 500 (for example configured according to the or several of the embodiments 100 to 400), in a schematic top view or cross-sectional view, in which the waste liquid feed includes a valve 502 (also referred to as the inlet-side valve) which is coupled to the container 102 (for example coupled with it). The valve 502 can be configured as a shut-off valve, for example.

The valve 502 can be configured to be manually actuatable, for example. For this purpose, the valve 502 can include a manual actuating device, the actuation of which causes the valve to open or close. Examples of the manual actuating device include: a manual lever or a manual wheel.

The valve 502 facilitates the assembly and/or conversion of the waste liquid-collecting arrangement 151 even further. Clearly, the valve 502 can be closed when the corresponding waste liquid feed is not required, for example is blind, or when the fluid-conducting connection of a connected liquid source to the collecting space 102*h* is to be canceled (also referred to as disconnection or separation). This facilitates, for example, reacting to different or variable assembly situations.

Figure 6:
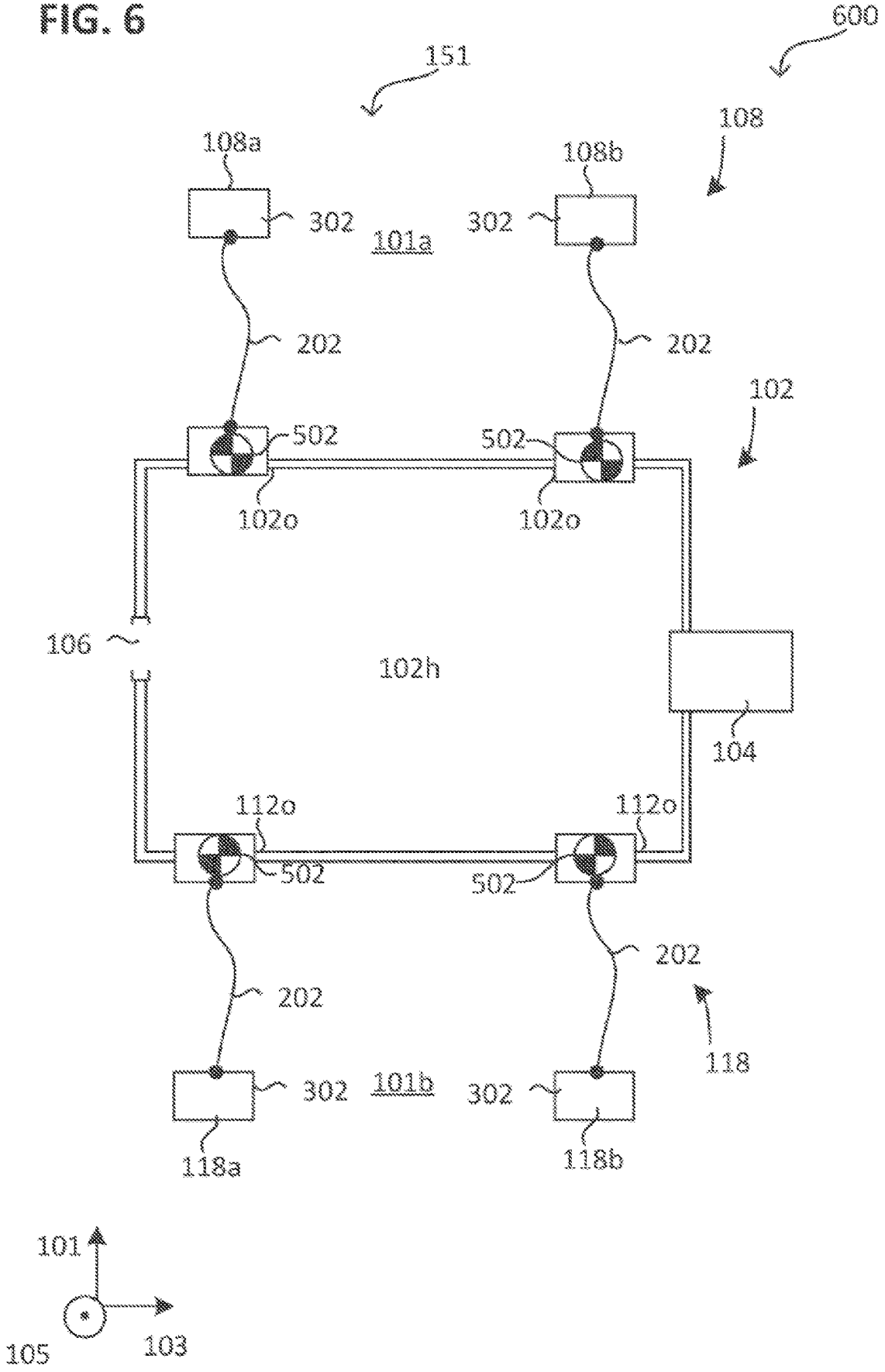

FIG. 6 illustrates a waste liquid-collecting arrangement 151 according to various embodiments 600 (for example configured according to the or several of the embodiments 100 to 500), in a schematic top view or cross-sectional view, in which the valve is connected between the collecting space 102*h* and the hose 202 (for example negative pressure hose) and/or the feed fitting 302.

Figure 7:
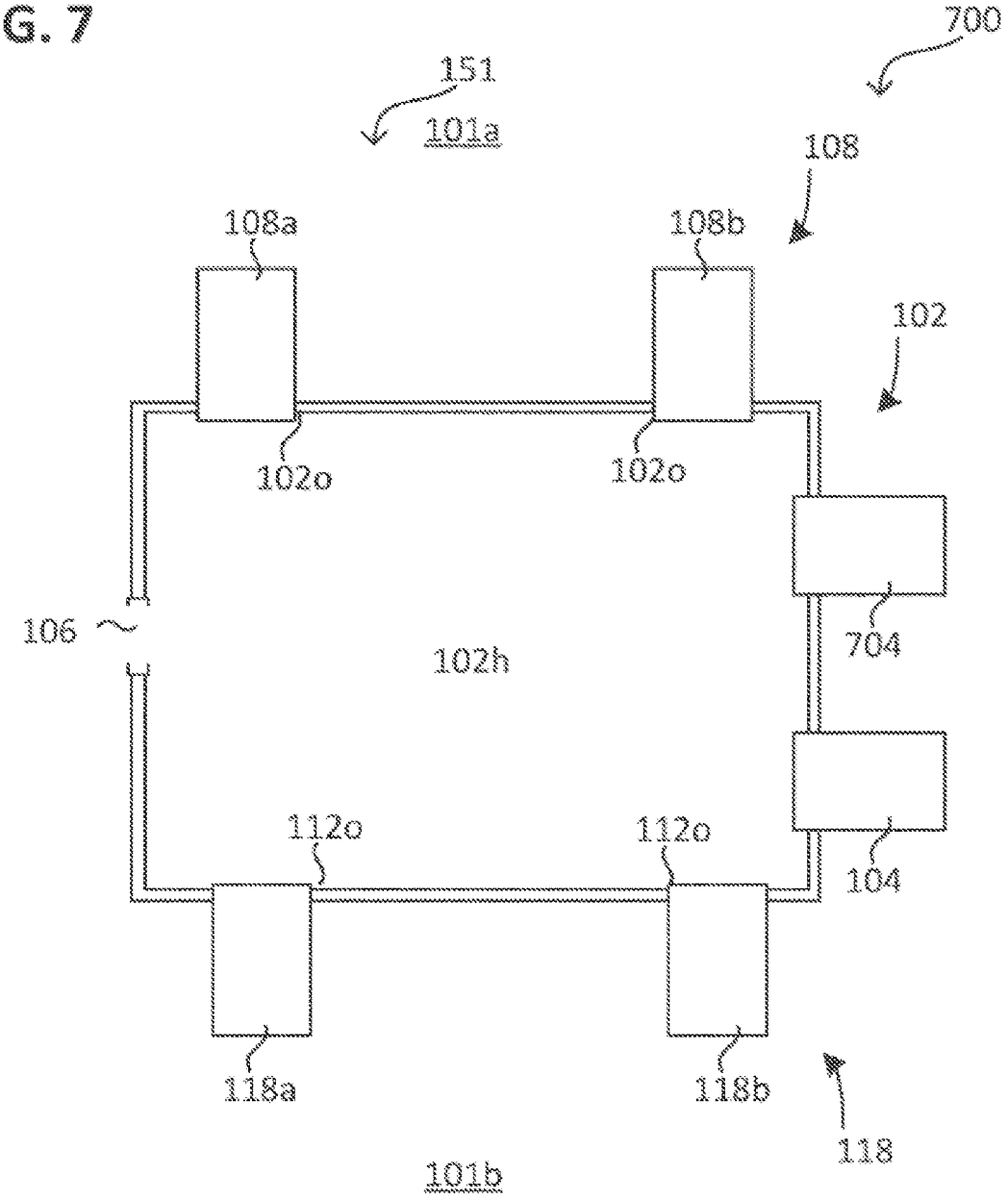
Figure 7:
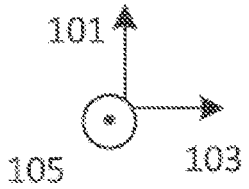

FIG. 7 illustrates a waste liquid-collecting arrangement 151 according to various embodiments 700 (for example configured according to the or several of the embodiments 100 to 600), in a schematic top view or cross-sectional view, in which the waste liquid-collecting arrangement 151 furthermore includes one or more than one pressure compensation fitting 704, which is coupled to the collecting space 102*h*. The or each pressure compensation fitting 704 can be part of the container 102, for example. For example, the or each pressure compensation fitting 704 can include a protruding pipe stub. The more than one pressure compensation fitting 704 can include two pressure compensation fittings 704 (also referred to simply as left pressure compensation fitting and right pressure compensation fitting), between which the cavity 102*h* is arranged. This simplifies assembly.

The pressure compensation fitting 704 ensures that the collecting space 102*h* can receive gas (for example air) from the outside when the waste liquid is withdrawn from it (for example is extracted). Similarly, the collecting space 102*h* can release gas (for example, air) when receiving waste liquid or being heated. This facilitates the operation of the waste liquid-collecting arrangement 151.

Optionally, an inactive extraction fitting (if present) or the corresponding opening in the container 102 can be used as the pressure compensation fitting 704. This reduces the complexity of the waste liquid-collecting arrangement 151.

Figure 8:
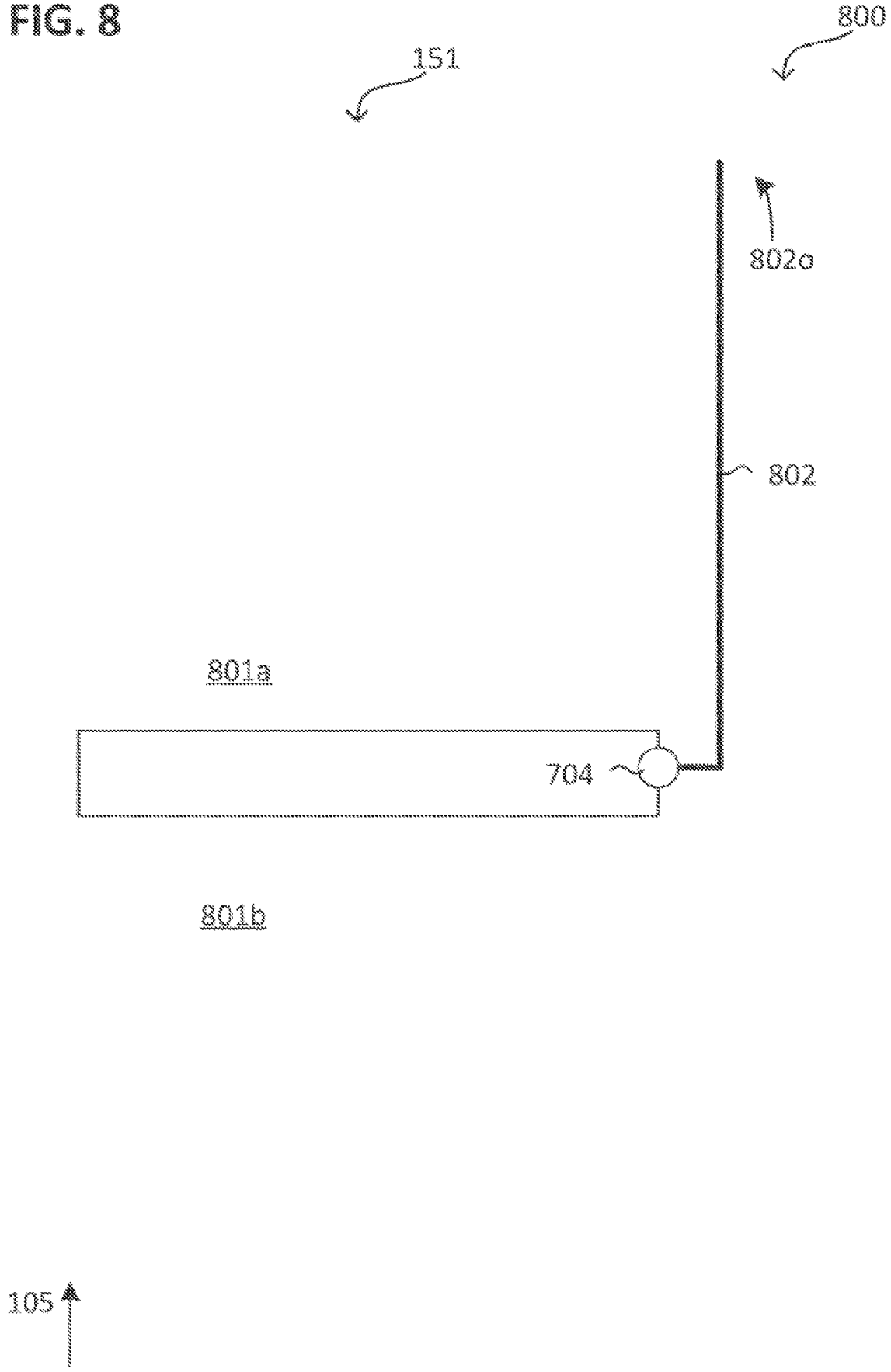

FIG. 8 illustrates a waste liquid-collecting arrangement 151 according to various embodiments 800 (for example configured according to the or several of the embodiments 100 to 700), in a schematic top view or cross-sectional view, in which it includes an at least partially vertically extending pressure compensation line 802 (also referred to as a down pipe or as a ventilation line), which is coupled by means of the pressure compensation fitting 704 to the collecting space 102*h*. The down pipe 802 can include an opening 802*o* (also referred to as an inlet opening) on the inlet side and can face toward the pressure compensation fitting 704 on the outlet side (for example, can be coupled thereto). The inlet opening 802*o* can be located higher relative to a reference of the waste liquid-collecting arrangement 151 or can be exposed to a lower atmospheric air pressure than the reference. The reference can be, for example, the pressure compensation fitting 704 or the collecting space 102*h*.

For example, the inlet opening 802*o* can have a greater height position relative to a zero level than the reference. The zero level is understood to mean an area to which the height position zero is assigned, for example according to the so-called "European Vertical Reference System" (EVRS). In the following, the more easily understood device-specific zero level, which corresponds to the height position of the reference, is used to indicate the height position. However, what has been described can also apply to another zero level, for example the geodetic zero level (for example sea level height, normal height zero, or Vienna zero).

For example, the height position of the inlet opening 802*o* (for example, measured along the direction of gravity) can be greater than an assembly value. The assembly value represents the possible assembly situation. The assembly value can be, for example, approximately 0.5 m or greater than approximately 0.5 m (meters), for example approximately 1 m or greater than approximately 1 m, for example approximately 2 m or greater than approximately 2 m, for example approximately 3 m or greater than approximately 3 m, for example approximately 4 m or greater than approximately 4 m. Accordingly, the down pipe can have a length that is greater than the assembly value. The direction of gravity can be opposite to direction 105.

Figure 9:
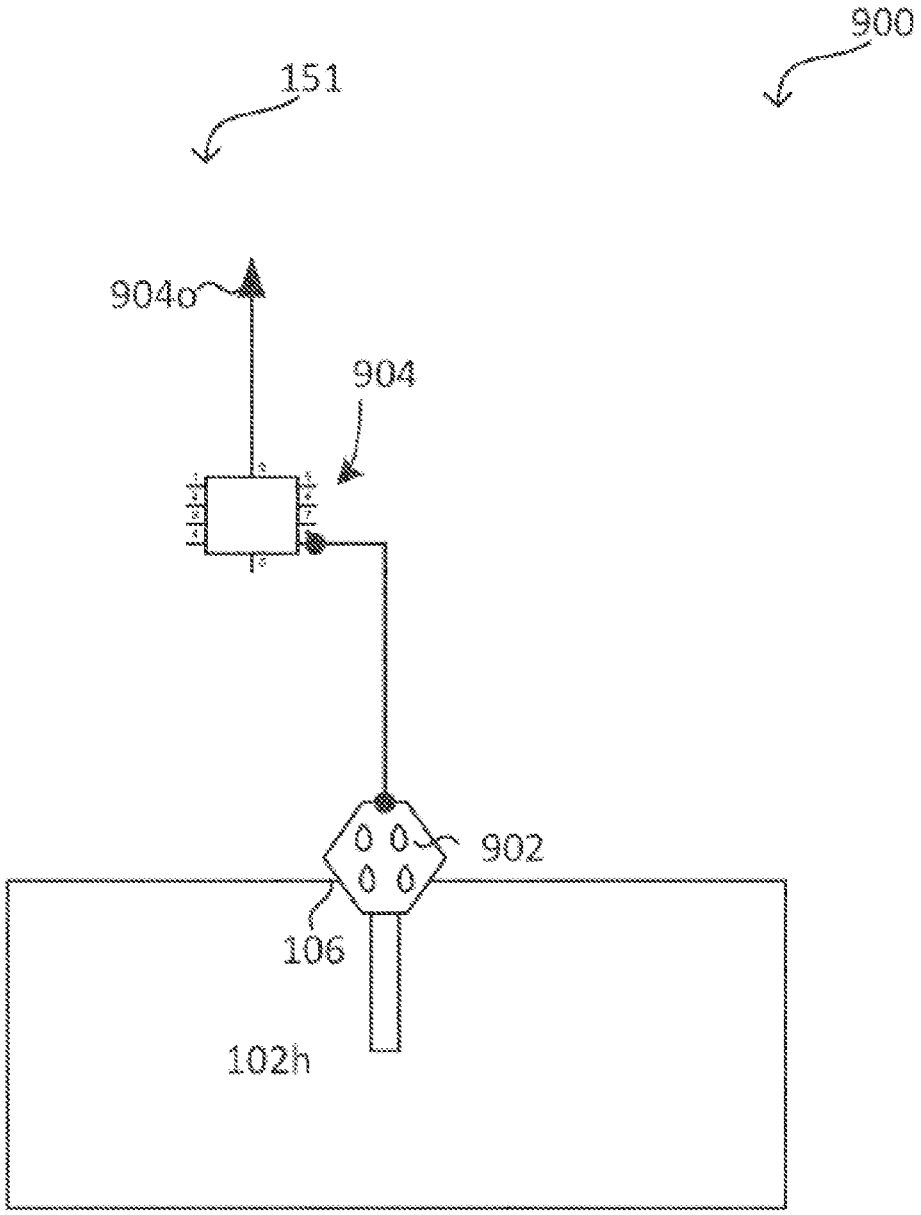

FIG. 9 illustrates a waste liquid-collecting arrangement 151 according to various embodiments 900 (for example configured according to the or several of the embodiments 100 to 800) in a schematic circuit diagram, in which it includes a sensor 902 and a sensor circuit 904.

The sensor 902 is configured to detect the waste liquid in the collecting space 102*h* (also referred to as liquid sensor 902). A sensor (also referred to as a detector) can be understood herein as a transducer that is configured to qualitatively or quantitatively detect a property of its environment corresponding to the sensor type, for example a physical or chemical property and/or a material composition. The measured variable is the physical variable to which the measurement by means of the sensor applies. Depending on the complexity of the environment of the sensor to be measured, the sensor can be configured to only be able to distinguish between discrete (for example two) states of the measured variable (also referred to as a measuring switch), for example to be able to distinguish between more than two states of the measured variable, or to quantitatively detect the measured variable. The measuring switch (as part of a sensor also referred to as a switch for short) can only distinguish, for example, whether the measured variable meets a criterion (for example exceeds or falls below a threshold value) or does not meet the criterion. An example of a measuring switch is a capacitive liquid sensor that is configured to detect whether a fill level as a measured variable has reached the location of the sensor or not, for example by detecting whether its capacitance is changed due to contact with the waste liquid or not. An additional example of a measuring switch is a float switch that switches when a float exceeds a certain position. An example of a quantitatively detected measured variable is, for example, a continuously recorded fill level (also referred to as a fill level sensor), which is detected, for example, by means of radiation (radar, sound, or light). The liquid sensor can be configured, for example, as a fill level sensor (also referred to as a level sensor).

The liquid sensor 902 can extend into the collecting space 102*h*, for example through the sensor opening 106. Alternatively or additionally, the liquid sensor 902 can be fluidically connected to the collection chamber 102*h*, for example by means of the sensor opening 106.

The liquid sensor 902 can be part of a measurement chain which includes a corresponding infrastructure (for example including a processor, storage medium, and/or bus system or the like). The measurement chain can be configured to control the corresponding sensor (e.g., water sensor, pressure sensor, and/or actuation sensor), to process its detected measured variable as an input variable and, based thereon, to provide an electrical signal (also referred to as a sensor signal) as an output variable, which indicates the state of the input variable for the represented time of detection. The measurement chain can be or become implemented by means of the sensor circuit 904.

The sensor circuit 904 is configured to detect the waste liquid in the cavity by means of the liquid sensor 902, for example its fill level (also referred to as level) and/or at least its presence at the location of the liquid sensor 902. The sensor circuit 904 is furthermore configured to output the sensor signal 9040 based on a result of detecting the waste liquid in the cavity 102*h*. The result of the detection can have, for example, the actual state of the waste liquid in the collecting space 102*h* as a measured variable, for example its level and/or presence (for example absence and/or presence).

The sensor signal 904*o* can be an analog signal, for example. The sensor signal 904*o* can be a digital sensor signal, for example. The digital sensor signal can include a message, for example, which is formed, for example, in accordance with a network communication protocol (for example a fieldbus communication protocol). The message can, for example, include a specification about the actual state of the waste liquid in the cavity 102*h*. However, in a simpler implementation, the digital sensor signal can also assume only two discrete logical states, one logical state of which indicating that the waste liquid is touching the liquid sensor 902 and the other logical state indicating that the waste liquid is at a distance from the liquid sensor 902.

Figure 10:
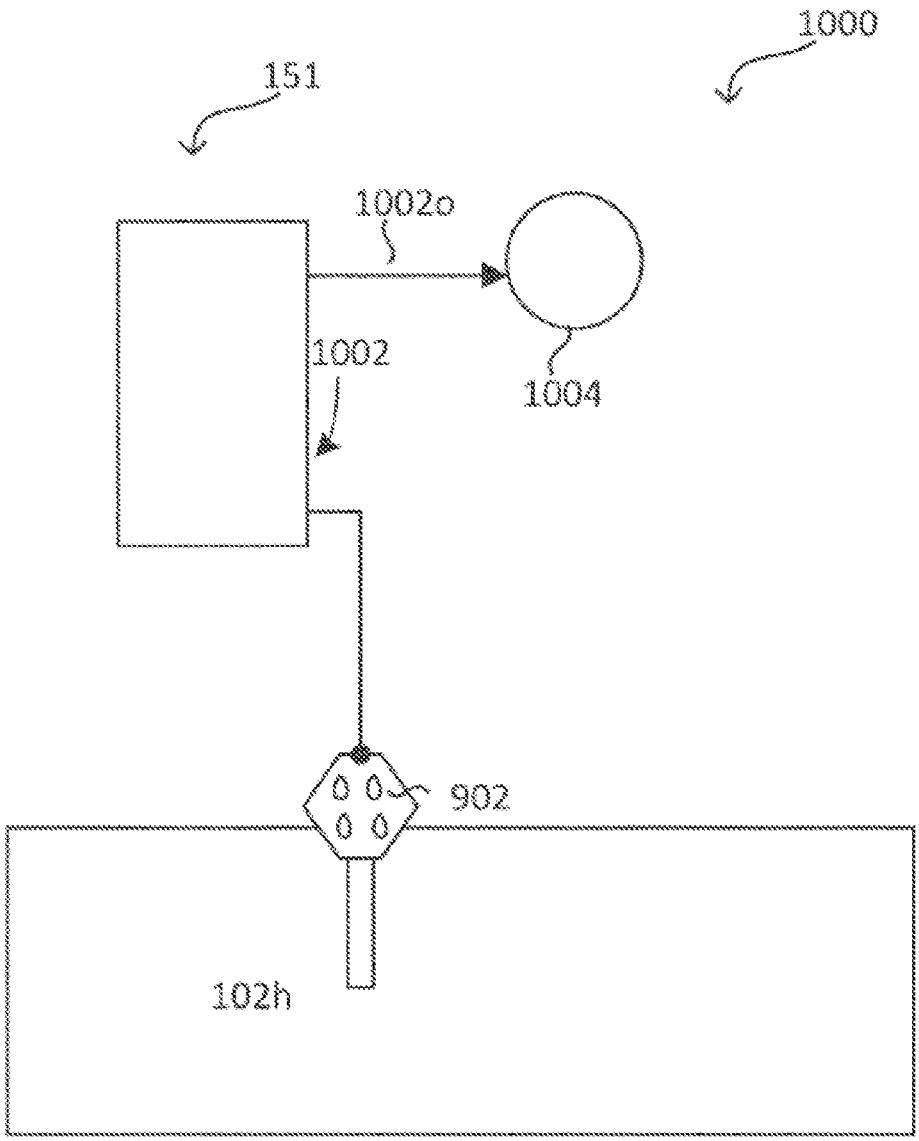

FIG. 10 illustrates a waste liquid-collecting arrangement 151 according to various embodiments 1000 (for example configured according to the or several of the embodiments 100 to 900) in a schematic circuit diagram, in which it includes a control device 1002 and a drive device 1004. The control device 1002 can, for example, include the sensor circuit 904 or can also be or become provided separately therefrom.

The control device 1002 can be configured to actuate the drive device 1004 (for example by means of a message according to a network communication protocol, for example a fieldbus communication protocol). For this purpose, the control device 1002 can output a control signal 10020 based on the sensor signal or based on the result of detecting the waste liquid in the cavity 102*h* (also referred to as liquid detection).

The control signal 1002*o* can be an analog signal, for example. The control signal 1002*o* can be a digital sensor signal, for example. The digital control signal 1002*o* can include a message, for example, which is formed, for example, in accordance with a network communication protocol, for example a fieldbus communication protocol. The message can include a specification on the target state of drive device 1004, for example. In a simpler implementation, however, the digital sensor signal can also assume only two discrete logical states, of which one logical state indicates a first target state of the drive device 1004 and the other logical state indicates a second target state of the drive device 1004. Alternatively, the message can include corresponding instructions for the drive device 1004.

Figure 11:
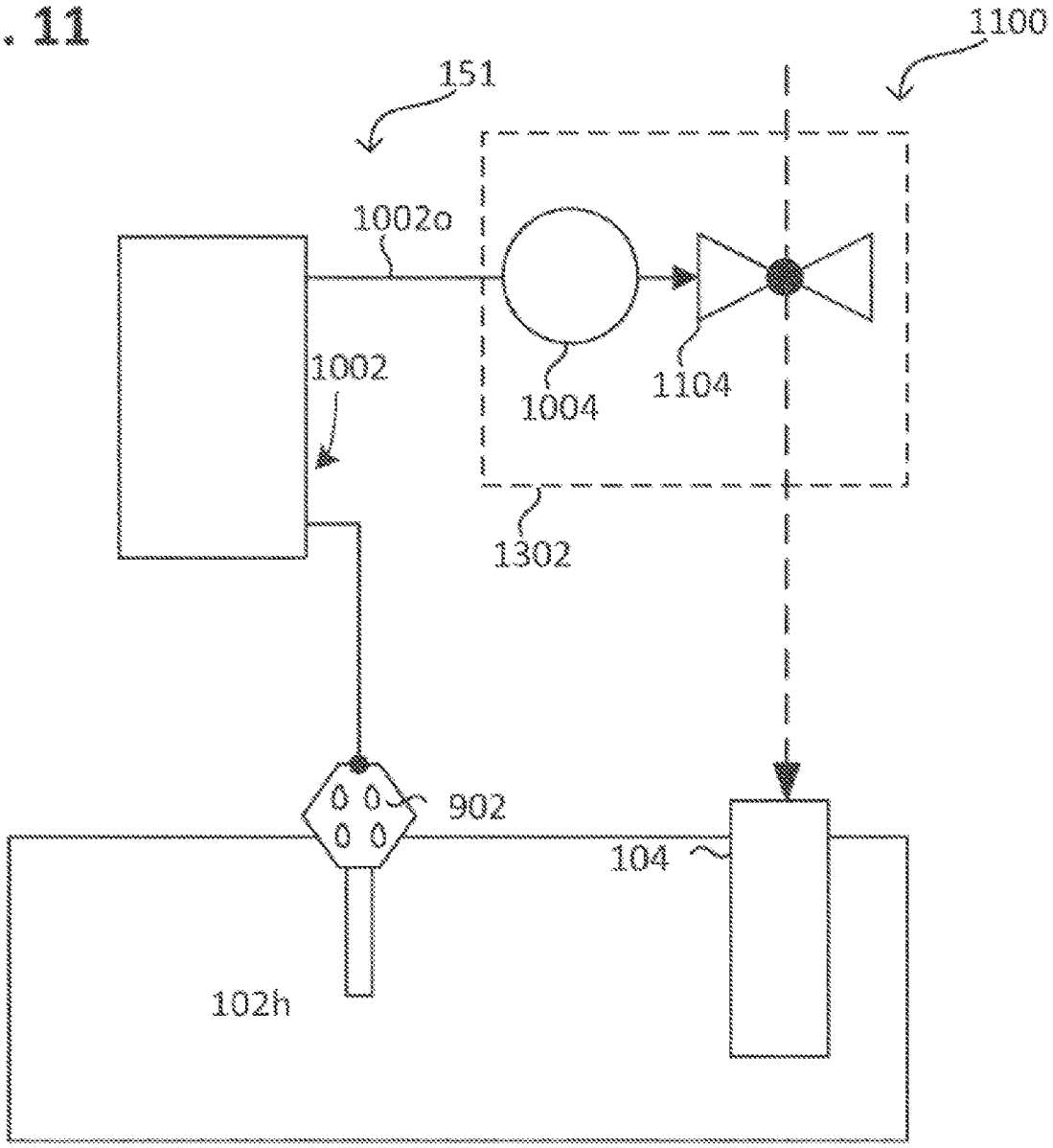

FIG. 11 illustrates a waste liquid-collecting arrangement 151 according to various embodiments 1000 (for example configured according to the or several of the embodiments 100 to 1000) in a schematic circuit diagram, in which it includes an extraction valve 1104. The driving device 1004 (for example, a motor or a magnetic drive) can be coupled to the extraction valve 1104 and configured to open (i.e., bring into an open state) or close (i.e., bring into a closed state) the extraction valve 1104, for example according to the sensor signal 1002*o*. If the extraction valve 1104 is in the open state, a negative pressure present at the extraction valve 1104 can be applied at the extraction fitting 104. Illustratively speaking, extraction can include bringing the extraction valve valve 1104 into an open state for a duration (also referred to as an open duration) and then bringing it into the closed state. The open duration can be stored, for example by means of the control device 1002.

The extraction can be triggered (initiated) by the control device 1002 itself (for example autonomously), for example in response to the result of the liquid detection meeting a criterion (also referred to as a triggering criterion).

Figure 12:
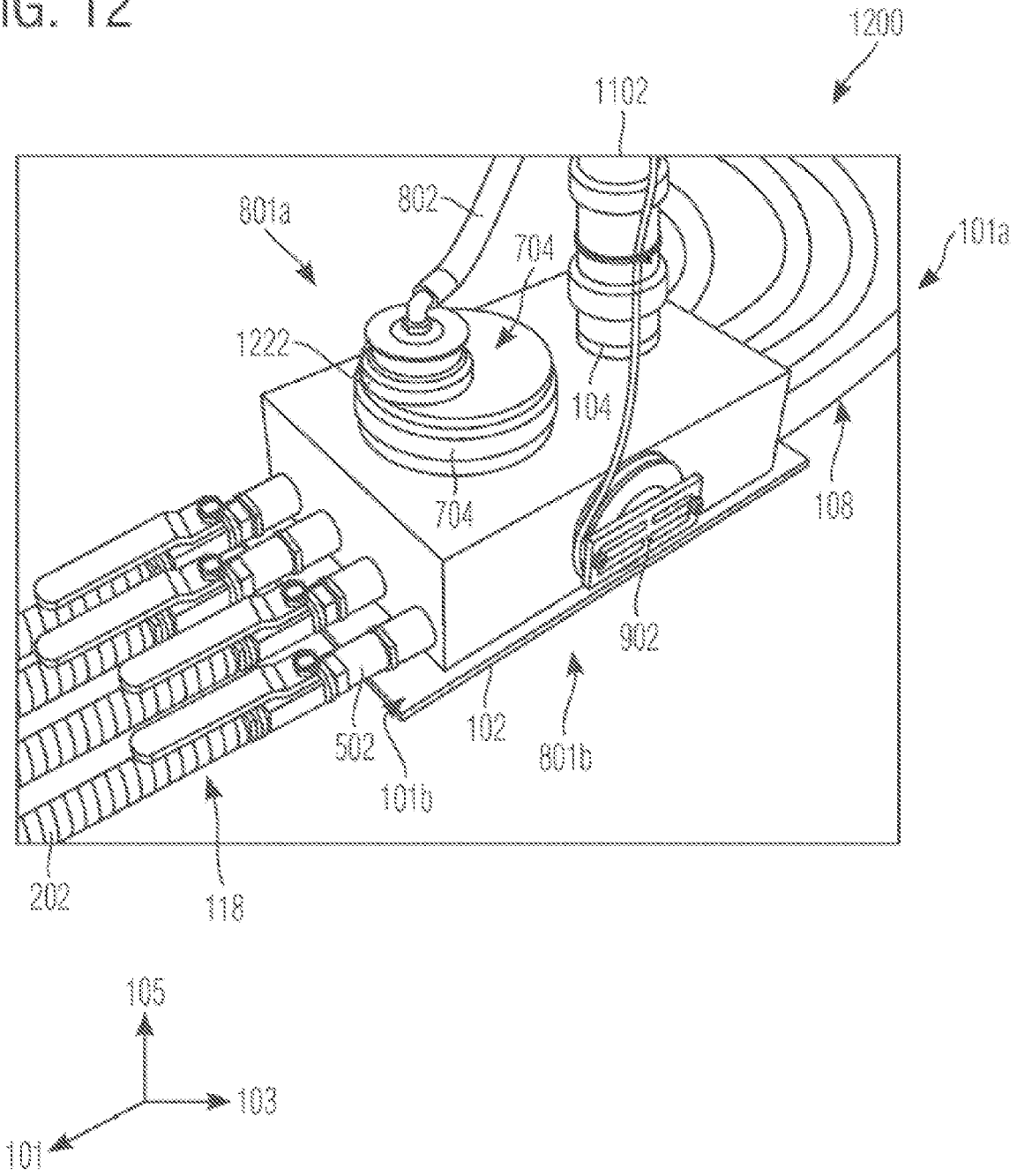

FIG. 12 illustrates a waste liquid-collecting arrangement 151 according to various embodiments 1200 (for example configured according to the or several of the embodiments 100 to 1100) in a schematic perspective view. The pressure compensation fitting 704 can optionally include a (for example, plate-shaped) reducing part 1222 which connects the container 102 to the down pipe 802. In this way, the pressure compensation fitting 704 can have a comparatively large opening of the container 102 which can be reduced in size by means of the producing part 1222. The large opening of the container 102 facilitates its maintenance (for example cleaning).

Figure 13:
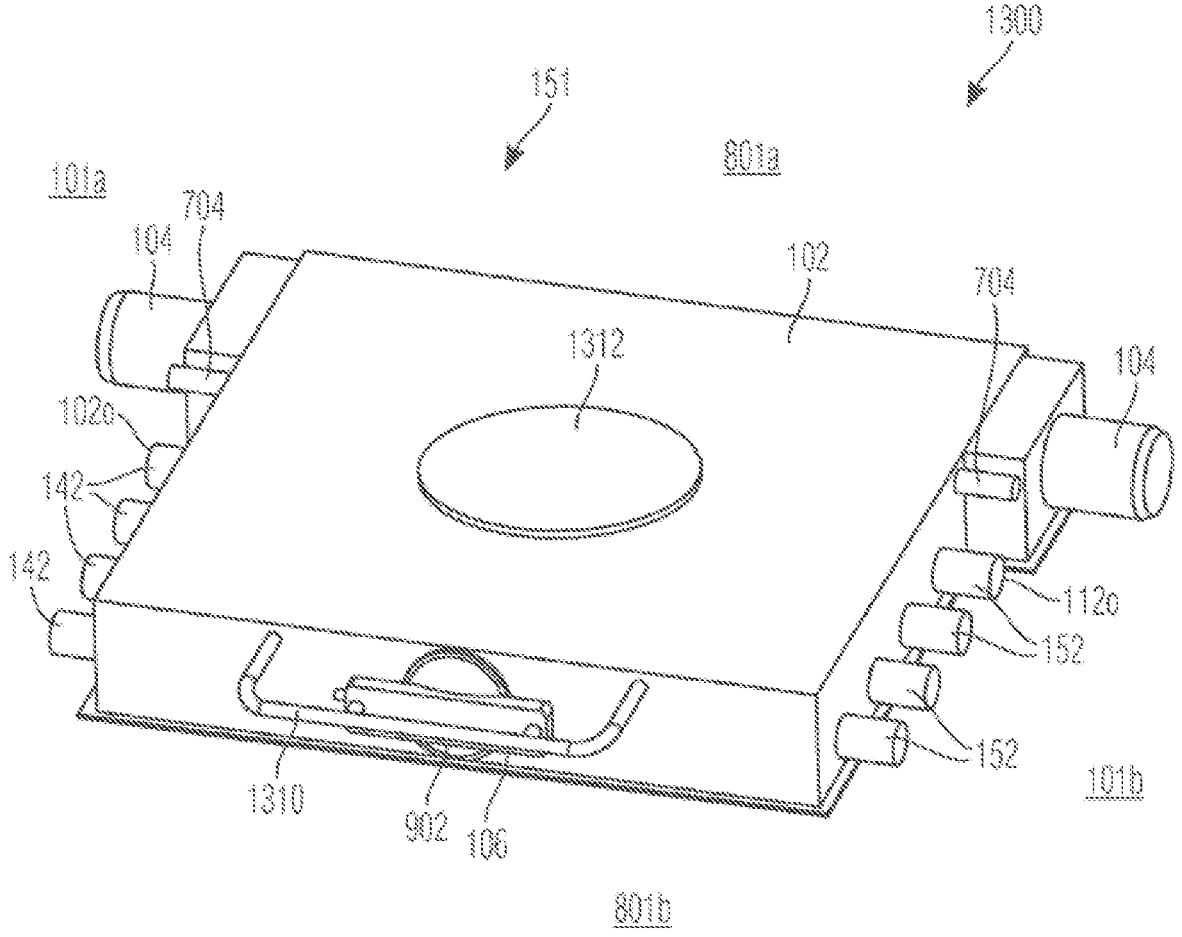

FIG. 13 illustrates a waste liquid-collecting arrangement 151 according to various embodiments 1300 (for example configured according to the or several of the embodiments 100 to 1200) in a schematic perspective view. As explained above, the container 102 includes: a first (for example left) extraction fitting 104 (for example in the form of a protruding pipe stub) which opens into the cavity 102*h* on the first side 101*a* of the container, and a second (for example right) extraction fitting 104 (for example in the form of a protruding pipe stub) which opens into the cavity 102*h* on the second side 101*b* of the container. Furthermore, the container 102 includes multiple first inlet nozzles 142 (for example each in the form of a protruding pipe stub) on the first side 101*a*, each inlet nozzle 142 of which includes a first opening 102*o* which opens into the cavity 202*h*. Furthermore, the container 102 includes multiple second inlet nozzles 152 (for example each in the form of a protruding pipe stub) on the second side 101*b* each inlet nozzle 152 of which includes a second opening 112*o* which opens into the cavity 202*h*. The container 102 can be monolithic and/or manufactured from a polymer, for example. This simplifies the production.

Optionally, the container 102 includes a handle 1310. This makes handling easier.

The container 102 optionally includes a maintenance opening 1312 including a cover (for example on its upper side or its cover 102*d*). This additionally makes handling easier.

Figure 14:
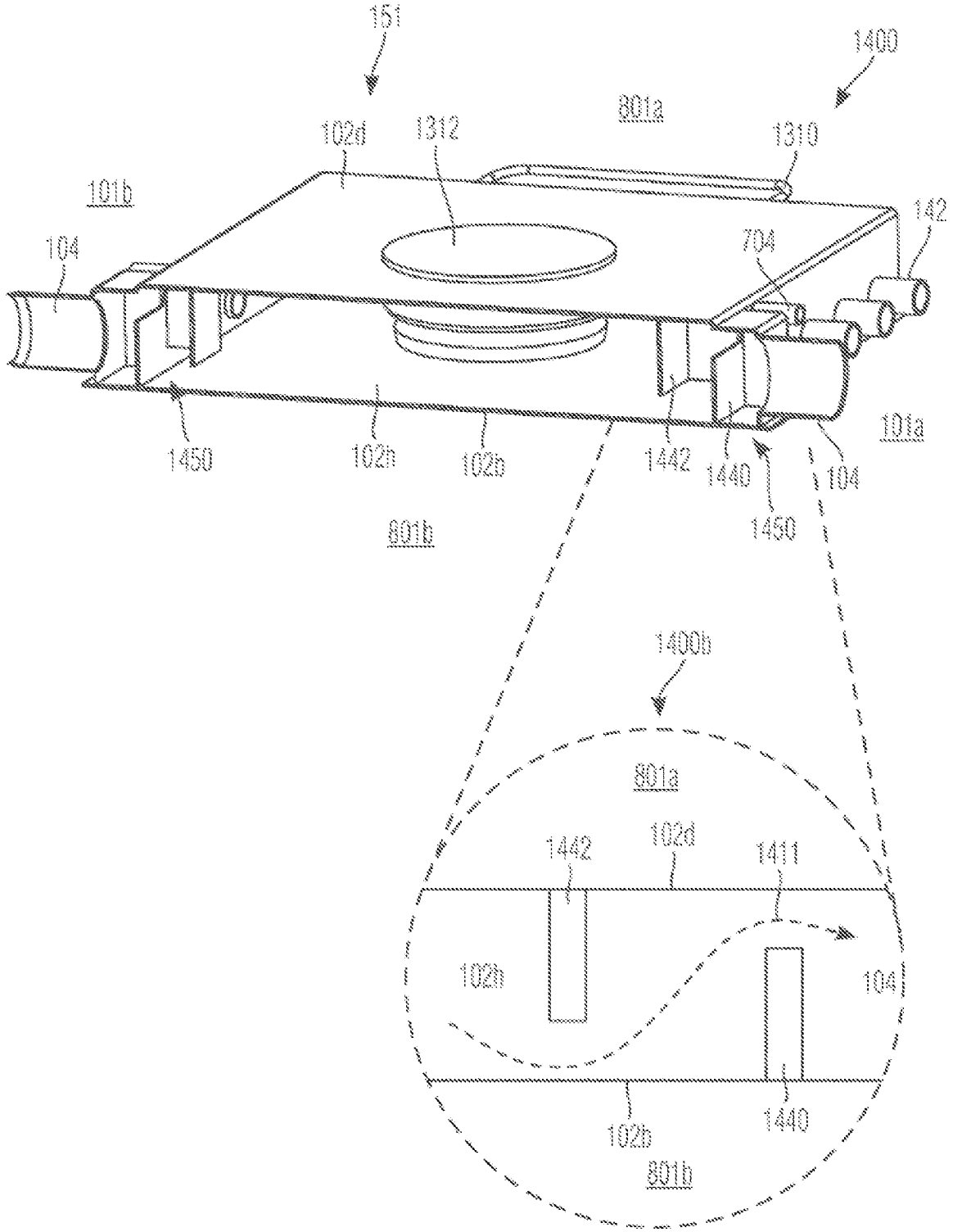

FIG. 14 illustrates a waste liquid-collecting arrangement 151 according to various embodiments 1400 (for example configured according to the or several of the embodiments 100 to 1300) in a sectional schematic perspective view✓ and cross-sectional view 1400*b*, in which each extraction fitting 104 opens into a fluid guiding device 1450. The fluid guiding device 1450 can be configured, for example, to guide, for example to deflect and/or curve, the fluid exchange path 1411 along which fluid reaches the extraction fitting 104. The fluid guiding device 1450 can be configured, for example, to change, for example to constrict and/or enlarge, the fluid exchange cries section through which the fluid reaches the extraction fitting 104.

The fluid guiding device 1450 can, for example, include a meandering fluid exchange channel (for example similar to a siphon). The fluid guiding device 1450 can include, for example, one or more than one constriction of the fluid exchange cross section.

According to various embodiments, the fluid guiding device 1450 can include an overflow protection device 1440 and/or a suction protection device 1442.

The overflow protection device 1442 is illustratively configured to inhibit the liquid from entering the extraction fitting 104 from the cavity 102*h*, thus increasing the reliability of the extraction. Specifically, the overflow protection device 1442 can be configured so to block liquid transport through the fluid guiding device 1450 into the extraction fitting 104 when the fluid guiding device 1450 is not subjected to a gas pressure differential (i.e., only gravitationally driven) and the liquid in the cavity 102*h* has a level below a threshold value (also referred to as overflow level). For example, the overflow level can be less than the trigger level and/or greater than approximately 0.5 cm, for example, than approximately 1 cm, for example, than approximately 2 cm, for example, than approximately 3 cm.

The overflow protection device 1440 shown here as an example can, for example, include a wall (also referred to as a retaining wall) that protrudes into the container 102 from below. A trough can thus be formed between multiple overflow protection devices 1440, into which the cavity 102*h* protrudes.

The suction promoting device 1442 is illustratively configured to encourage the liquid from the cavity 102*h* to enter the extraction 104 when the extraction occurs (for example, when the fluid guiding device 1450 is subjected to a gas pressure differential). Specifically, the suction promoting device 1442 can be configured so to block a gas exchange through the overflow protection device 1440 when it is subjected to a gas pressure differential and the liquid has a level above a threshold value (also referred to as extraction level). For example, the extraction level can be less than the trigger level and/or than the overflow level, for example, less than approximately 5 cm, for example, than approximately 3 cm, for example, than approximately 1 cm.

The suction promoting device 1442 shown here as an example can, for example, include a wall (also referred to as a suction wall) that protrudes into the container 102 from above (and is at a distance from the bottom). The distance between the bottom 102*b* of the container 102 and the suction wall can be, for example, less than approximately 5 cm, for example approximately 3 cm, for example approximately 1 cm.

FIG. 15 illustrates an actuator 1302 of the waste liquid-collecting arrangement 151 according to various embodiments 1500 (for example configured according to the or several of the embodiments 100 to 1400) in a schematic perspective view. The actuator 1302 can include the extraction valve 1104 and the drive device 1004, which are arranged, for example, within a housing of the actuator.

The actuator 1302 can also include an input fitting 1104*e* which couples the waste liquid-collecting arrangement 151, for example its extraction fitting 104, to the extraction valve 1104. The actuator 1302 can include an output fitting (concealed in the view) that couples a pump system 1202 or manifold 1120 to the extraction valve 1104. The actuator 1302 can furthermore include a control fitting 1104*s* that couples the control device 1002 to the drive device 1004.

FIG. 16 illustrates a waste liquid drainage system 153 according to various embodiments 1600 in a schematic perspective view, which includes the waste liquid-collecting arrangement 151 (for example configured according to the or several of the embodiments 100 to 1500). For example, the waste liquid drainage system 153 can be part of or provide a more complex disposal infrastructure. The waste liquid drainage system 153 can be or become arranged in a building, for example.

The waste liquid-collecting arrangement 151 can be coupled to multiple liquid sources 1110, of which each liquid source 1110 is coupled to at least one waste liquid feed of the multiple first waste liquid feeds 108 or the multiple second waste liquid feeds 118. For example, a first liquid source 1110 can be coupled to the first waste liquid feed 108*a*, a second liquid source 1110 to the second waste liquid feed 118*a*, and/or a third liquid source 1110 to the additional first waste liquid feed 108*b*.

Examples of a liquid source 1110 include: a refrigerator, a freezer, an air conditioner, a heat exchanger, a cool box, a chiller (for example a compression chiller), a refrigeration unit, etc. More generally, the liquid source 1110 can be configured to extract thermal energy and to emit it elsewhere.

The liquid source 1110 can include, for example, a liquid outlet (for example coupled to a trough and/or drainage channel) which is coupled to the waste liquid-collecting arrangement 151. The liquid outlet (for example a condensate outlet) can be opened in the direction of gravitation. For example, the liquid source 1110 can be configured for gravity drainage.

The waste liquid drainage system 153 can include a negative pressure line 1120 (also referred to more illustratively as a manifold 1120). The manifold 1120 can, for example, be arranged above the one or more than one 1110 and/or can have a negative pressure in the interior. Alternatively or additionally, a height position of the manifold line 1120 can be approximately 0.5 m or greater than approximately 0.5 m (meters), for example approximately 1 m or greater than approximately 1 m, for example approximately 2 m or greater than approximately 2 m, for example approximately 3 m or greater than approximately 3 m, for example approximately 4 m or greater than approximately 4 m, for example approximately 5 m or greater than approximately 5 m, for example approximately 6 m or greater than approximately 6 m, for example approximately 7 m or greater than approximately 7 m, for example approximately 8 m or greater than approximately 8 m, for example approximately 9 m or greater than approximately 9 m.

The waste liquid-collecting arrangement 151 can include a riser line 1102 (illustratively a vertical negative pressure line, also referred to as a lifting line), which is coupled to the extraction fitting 104. The riser line 1102 can, for example, include or be formed from a pipe (also referred to as a lifting pipe).

The riser line 1102 can be coupled to the manifold 1120, for example, by means of the extraction valve 1104 (if present). The extraction valve 1104 can be configured, when brought into a closed state, to interrupt the fluidic connection between the collecting space 102*h* and the manifold 1120. The extraction valve 1104 can be configured, when brought into a open state, to cancel the interruption of the fluidic connection between the collecting space 102*h* and the manifold 1120. Extraction can include bringing the extraction valve 1104 in an open state.

FIG. 17 illustrates the waste liquid drainage system 153 according to various embodiments 1700 in a schematic perspective view, which can be configured, for example, according to the embodiments 1600, in which the waste liquid drainage system 153 can include a pump system 1202 and one or more than one manifold 1120. The waste liquid drainage system 153 can include at least one (i.e., one or more than one) waste liquid-collecting arrangement 151 per manifold 1120, of which each waste liquid-collecting arrangement is coupled, for example, to one or more than one liquid source 1110 and/or to the manifold 1120.

The waste liquid drainage system 153 can include the pump system 1202, which is configured to generate negative pressure (for example, vacuum) in each negative pressure line 1120. The pump system 1202 can include one or more than one pump. For example, the pump system 1202 can be connected to a sewer that runs underground.

The pump system 1202 can be configured to regulate the pressure (the negative pressure) in the manifold 1120, for example to a value in a range from approximately 0.4 bar to approximately 0.6 bar.

FIG. 18 illustrates a waste liquid drainage system 153 according to various embodiments 1800 in a schematic perspective view, which can be configured, for example, according to the embodiments 1600 or 1700. The waste liquid drainage system 153 includes: the collecting container 102; the waste liquid feeds 108, 118 (for example, each having a line 202, for example, a hose 202), a level switch 902 or another liquid sensor 902; the pressure compensation line 802 (also referred to as a ventilation line), for example including or consisting of a hose; multiple liquid sources 1110 (for example, each including a device that produces a liquid to be drained); the manifold 1120 leading from the waste liquid-collecting arrangement 151 to the pump system 1202; the riser line 1102 (also referred to as the suction line); the extraction valve 1104 (for example, a vacuum emptying valve); the pump system 1202, for example including a pump station having one or more than one pump; and an emptying line 1602 leading from the pump system 1202 to a sewage system 1604 (for example, its sewer).

The waste liquid-collecting arrangement 151 (for example, a direct vacuum drainage unit) includes: the collecting container 102; multiple connecting lines 202 (for example, including hoses and/or pipes) which are connected to the devices 1110 to be emptied and the collecting container 102 (also referred to as collecting container); the extraction fitting 104 (for example, including an outlet hose or outlet pipe) connected to the collecting container 102 and the suction line 1102; the suction line 1102; the vacuum emptying valve 1104 (also referred to as the vacuum outlet valve); and the controller 1002 (also referred to as a control unit).

In operation, liquid from each of the devices 1110 to be emptied may be freely drained by gravity into the collecting container 102 via the connecting line 202 (for example, including connecting hoses 202 or connecting popes 202) connected to the inlet nozzles. The collecting container 102 can gradually be filled with liquid up to a trigger level, which is detected (for example monitored) by means of the level switch 902 or sensor 902. The liquid to be emptied can optionally fill the connecting lines 202. As a result, the absorption capacity for liquid can be expanded beyond that of the collecting container 102 itself. The overall length of all connecting lines 202 can be adapted to the respective operating conditions and does not have to be invariant. The free (blind) inlet nozzles an be closed accordingly.

The air in the collecting container 102 above the liquid level can be vented via the vent line 802 (for example, including a vent hose or vent tube) connected to the left or right pressure compensation fitting 704 (also referred to as the vent fitting). The choice of the vent fitting 704 (for example position either left or right) can depend on the particular installation conditions, whichever is more applicable. The unused (blind) vent fitting 704 (if present) can be closed accordingly. The vent line 802 (for example a vent hose) can be configured in such a way that its open end (also referred to as an inlet opening) is arranged above an upper edge of the inlets of the devices 1110 to be drained. The vent line 802 can optionally include a check valve, a nozzle, a connecting piece, or a combination thereof.

The collecting container 102 can be or become connected to the suction line 1102 by means of a extraction fitting 104, for example, an outlet line (for example, an outlet hose or an outlet pipe) connected thereto, which is connected to the left or right extraction fitting 104. The choice of the extraction fitting 104 (for example position either left or right) can depend on the particular installation conditions, whichever is better in accordance with the direction of the suction line 1102. The unused (blind) extraction fitting 104 (if present) can be closed accordingly. The length of the optional outlet line can vary depending on the specific installation situation.

When the liquid to be drained has reached the trigger level of the level switch 902 or sensor 902, this triggers the opening of the extraction valve 1104 (also referred to as the vacuum outlet valve) on the suction line 1102. As a result, the negative pressure provided in the manifold 1120 (for example, a pipe system) extracts the liquid from the collecting container 102 and the connecting lines 202 via the suction line 1102 and the pump system 1202 (also referred to as the vacuum system). Thereafter, the extraction valve 1104 is automatically closed and the waste liquid-collecting arrangement 151 is ready to collect the next portion of liquid from the devices 1110 to be emptied.

To achieve greater reliability, the liquid can optionally be inhibited from flooding the outlet line due to gravity. For this purpose, each extraction fitting 104 (for example the outlets of the collecting container 102) can open into an overflow protection device (not shown).

Optionally, each extraction fitting 104 (for example the outlets of the collecting container 102) can open into a suction promoting device in order to achieve a better suction effect.

FIG. 19 illustrates a method 1900 according to various embodiments for assembling the waste liquid-collecting arrangement 151 described herein in a schematic flow chart. The method 1900 can include, in 1901, coupling at least a first source of waste liquid (for example condensate) to at least one feed fitting of the multiple first waste liquid feeds 108, and, in 1903, coupling at least a second source of waste liquid (for example condensate) to at least one feed fitting of the multiple second waste liquid feeds 118. If the at least one first liquid source includes multiple first liquid sources, the multiple first waste liquid feeds 108 can comprise one waste liquid feed per liquid source of the multiple first liquid sources, which is coupled to the liquid source of the multiple first liquid sources. If the at least one first liquid source includes multiple second liquid sources, the multiple second waste liquid feeds 118 can comprise one waste liquid feed per liquid source of the multiple second liquid sources, which is coupled to the liquid source of the multiple second liquid sources.

The coupling of a liquid source to a waste liquid feed (for example its feed fitting) can include the latter being connected to one another fluidically and/or sealed to the outside. Waste liquid (for example condensate) discharged from the liquid source can thus be received by means of the waste liquid feed and fed to the collecting space **102*h***.

The method 1900 can, in 905, optionally include switching one or more than one inlet-side valve, for example of the multiple first waste liquid feeds 108 and/or the multiple second waste liquid feeds 118.

The switching can include, for example, bringing an inlet-side valve of one waste liquid feed of the multiple first waste liquid feeds 108 or the multiple second waste liquid feeds 118, which is coupled to a liquid source, into an open state.

The switching can include, for example, bringing an inlet-side valve of one waste liquid feed of the multiple first waste liquid feeds 108 or the multiple second waste liquid feeds 118, which is not coupled to a liquid source, into a closed state.

The method 1900 can optionally include, in 1907, coupling the extraction fitting 104 to a pump system.

FIG. 20 illustrates a method 2000 according to various embodiments for operating the waste liquid-collecting arrangement 151 in a schematic flow chart. The method 2000 can include, in 2001, collecting waste liquid from a first device (for example, liquid source) coupled to a feed fitting of the multiple first waste liquid feeds 108 in the collecting space 102*h*. The method 2000 can furthermore include, in 2003, collecting waste liquid from a second device coupled to a waste liquid feed of the multiple second waste liquid feeds 108 in the cavity.

The method 2000 can furthermore include, in 2005, extracting the waste liquid from the collecting space 102*h* through the extraction fitting 104 by means of a negative pressure applied to the extraction fitting 104. The extraction 2005 can optionally include bringing the extraction valve 1104 into an open state, for example for the open duration, and for example bringing it into the dosed state after the open duration has elapsed.

The method 2000 can optionally include, in 2007, detecting the waste liquid in the collecting space 102*h* (also referred to as liquid detecting). The liquid detection 2007 can include detecting an actual state (for example actual level) of the waste liquid in the collecting space 102*h*.

The extraction 2005 may optionally be performed based on a result of the liquid deduction. The extraction 2005 can take place, for example, in response to the result of the liquid detection meeting a criterion (also referred to as a trigger criterion). The result of the liquid detection can include an actual state of the waste liquid in the collecting space 102*h*, for example an actual level of the waste liquid in the collecting space 102*h*. The criterion can be met, for example, when the actual level of the waste liquid exceeds a threshold value (also referred to as the trigger level).

FIG. 21 illustrates a waste liquid-collecting arrangement 151 according to various embodiments 2100 (for example the previous embodiments) in a schematic perspective view and FIG. 22A and FIG. 22B illustrate the waste liquid-collecting arrangement 151 in a schematic view from a different viewing angle 2200*a* or a sectional perspective view 2200*b*, respectively. As shown, the pressure compensation fitting 704 and the sensor opening 106 or the sensor 902 can be arranged on the same side of the collecting container 102, which facilitates the accessibility of the waste liquid-collecting arrangement 151. Alternatively or additionally, the pressure compensation line 802 can be angled.

In general for example according to the embodiments described herein, the at least one or more first liquid feeds (e.g. waste liquid feeds) and the one or more second liquid feeds (e.g. waste liquid feeds) can be coupled by means of the cavity to one another (for example fluidically) and/or to one or more than one (for example each) of the following: the pressure compensation fitting 704, the sensor opening 106, one or more than one extraction fitting 104.

Various examples are described hereinafter, which relate to the description above and the illustrations in the figures.

Example 1 is a liquid-collecting arrangement (for example, waste liquid-collecting the base) including: a container having a cavity (reservoir) for collecting liquid (for example, waste liquid); at least one extraction fitting (for example opening into the cavity on an upper side of the container) coupled (for example fluidically) to the cavity (also referred to as a hollow chamber or collecting space) for extracting the liquid (for example waste liquid) from the cavity by means of negative pressure; an optional sensor opening (for example, opening into the cavity on a third side of the container) connected to the cavity for detecting liquid (for example waste liquid) in the cavity; one or more first liquid feeds (for example waste liquid feeds) opening into the cavity on a first (for example laterally arranged) side of the container for feeding liquid (for example waste liquid) into the cavity; one or more second liquid feeds (for example waste liquid feeds) opening into the cavity on the first side or on a second (for example laterally arranged) side of the container, for feeding liquid (for example waste liquid) into the cavity, wherein the first side is opposite to the second side; wherein, for example, the at least one or more first liquid feeds (for example waste liquid feeds) and the one or more second liquid feeds (for example waste liquid feeds) are coupled to one another (for example fluidically) by means of the cavity.

Example 2 is the liquid-collecting arrangement according to Example 1, wherein the cavity is located between the mouths of the one or more first liquid feeds and the mouths of the one or more second liquid feeds.

Example 3 is the liquid-collecting arrangement according to Example 1 or 2, wherein the at least one extraction fitting includes multiple extraction fittings which are coupled to one another (for example fluidically) by means of the cavity.

Example 4 is the liquid-collecting arrangement according to any one of Examples 1 to 3, wherein the one or more first liquid feeds are coupled to one another and/or to the one or more second liquid feeds (for example fluidically) by means of the cavity.

Example 5 is the liquid-collecting arrangement according to any one of Examples 1 to 4, wherein the one or more second liquid feeds are coupled to one another and/or to the one or more first liquid feeds (for example fluidically) by means of the cavity.

Example 6 is the liquid-collecting arrangement according to any one of Examples 1 to 5, wherein at least one or each liquid feed of the one or more first liquid feeds and/or the one or more second liquid feeds includes a feed fitting, which is coupled (for example fluidically) to the cavity.

Example 7 is the liquid-collecting arrangement according to any one of Examples 1 to 6, wherein the one or more first liquid feeds (for example each first liquid feed) and/or the one or more second liquid feeds (for example each second liquid feed) and/or the at least one or each liquid feed includes one or more than one flexible hose (for example negative pressure hose) which is coupled, for example, to the cavity (for example fluidically); of which, for example, each hose (for example negative pressure hose) couples (for example fluidically) a feed fitting of the one or more first liquid feeds and/or the one or more second liquid feeds to the container.

Example 8 is the liquid-collecting arrangement according to any one of Examples 1 to 7, wherein the one or more first liquid feeds include one first hose (for example negative pressure hose) per feed fitting of the one or more first liquid feeds, which couples (for example fluidically) the feed fitting of the one or more first liquid feeds to the container; and/or wherein the one or more second liquid feeds include one second hose (for example negative pressure hose) per feed fitting of the one or more second liquid feeds, which couples (for example fluidically) the feed fitting of the one or more second liquid feeds to the container.

Example 9 is the liquid-collecting arrangement according to Example 7 or 8, wherein the or each hose (for example negative pressure hose) has a length, wherein the length is: 0:5 m (meters) or greater than approximately 0:5 m (meters), for example which is 1 m or greater than approximately 1 m, for example which is 2 m or greater than approximately 2 m, for example which is 3 m or greater than approximately 3 m. for example which is 4m or greater than approximately 4 m, for example which 5 m or greater than approximately for example which is 6 m or greater than approximately 6 m, for example which is 7 m or greater than approximately 7 m; and/or wherein the length is greater than a distance (or five times or ten times the distance) of the one or more first liquid feeds from the multiple second liquid feeds.

Example 10 is the liquid-collecting arrangement according to any one of Examples 1 to 9, wherein the one or more first liquid feeds (for example each first liquid feed) and/or the one or more second liquid feeds (for example each second liquid feed) and/or the at least one or each liquid feed includes a blocking device, preferably including or produced from a valve or a plug, which is coupled (for example fluidically) to the cavity; of which, for example, each blocking device (for example each valve) couples (for example fluidically) one feed fitting of the one or more first liquid feeds and/or the one or more second liquid feeds to the container.

Example 11 is the liquid-collecting arrangement according to any one of Example 10, wherein the one or more first liquid feeds include one blocking device per feed fitting of the one or more first liquid feeds, preferably including or produced from a valve or plug, which couples (for example fluidically) the feed fitting of the one or more first liquid feeds to the container; and/or wherein the one or more second liquid feeds include one blocking device per feed fitting of the one or more second liquid feeds, preferably including or produced from a valve or plug, which couples (for example fluidically) the feed fitting of the one or more second liquid feeds to the container.

Example 12 is the liquid-collecting arrangement according to any one of Examples 1 to 11 furthermore including: a pressure compensation fitting (for example for equalizing the negative pressure and/or opening into the cavity on an upper side of the container), which is preferably connected by means of the cavity to one or more than one of the following: the at least one extraction fitting, the one or more first liquid feeds, and/or to the one or more second liquid feeds: wherein the pressure compensation fitting optionally has a check fitting (for example a check valve) or is coupled thereto (for example fluidically), wherein the check fitting is configured, for example, to feed a fluid (for example gas) to the cavity when the liquid is extracted therefrom, wherein the pressure compensation optionally furthermore includes: a reducing part (for example in the form of a cover) for coupling to the container, wherein the pressure compensation setting is furthermore preferably connected by means of the cavity to the at least one extraction fitting and/or to one or more than one of the following: the one or more first liquid feeds and/or to the one or more second liquid feeds.

Example 13 is the liquid-collecting arrangement according to Example 12, furthermore including: a pressure compensation device (for example a down pipe), preferably including or produced from a hose or a pipe, which is coupled to the cavity (for example fluidically) by means of the pressure compensation fitting and/or itself extends at least partially (i.e., partially or completely) away from the pressure compensation fitting against the direction of gravity, wherein the pressure compensation device (for example the down pipe), preferably including a hose or a pipe, for example having a length which is greater than a dimension of the container and/or a circumference of the container; wherein the pressure insulation device (for example the down pipe), preferably comprising a hose or a pipe, for example has a length which is approximately 0.5 m or greater than approximately 0.5 m (meters), for example which is approximately 1 m or greater than approximately 1 m, for example which is approximately 2 m or greater than approximately 2 m, for example which is approximately 3 m or greater than approximately 3 m, for example which is approximately 4 m or greater than approximately 4 m.

Example 14 is the liquid-collecting arrangement according to example 13, wherein the length of the pressure compensation device (for example the down pipe), preferably comprising a hose or a pipe, is measured along a direction of gravity.

Example 15 is the liquid-collecting arrangement according to any one of Examples 1 to 14, wherein the multiple first liquid feeds include two or more liquid feeds (each of which includes, for example, a hose, a blocking device (for example a valve), and/or a feed fitting), for example three or more liquid feeds (each of which includes, for example, a hose, a blocking device (for example a hose), and/or a feed fitting), for example four or more liquid feeds (each of which includes, for example, a hose, a blocking device (for example a hose), and/or a feed fitting), for example 5, 6, 7, 8, 9, 10, or more liquid feeds.

Example 16 is the liquid-collecting arrangement according to any one of Examples 1 to 15, wherein the multiple second liquid feeds include two or more liquid feeds (each of which includes, for example, a hose, a blocking device (for example a valve), and/or a feed fitting), for example three or more liquid feeds (each of which includes, for example, a hose, a blocking device (for example a hose), and/or a feed fitting), for example four or more liquid feeds (each of which includes, for example, a hose, a blocking device (for example a hose), and/or a feed fitting), for example 5, 6, 7, 8, 9, 10, or more liquid feeds.

Example 17 is the liquid-collecting arrangement according to any one of Examples 1 to 16, wherein a number of liquid feeds of the one or more first liquid feeds is equal to the number of liquid feeds of the one or more second liquid feeds.

Example 18 is the liquid-collecting arrangement according to any one of Examples 1 to 17, wherein at least one or each liquid feed (for example its feed fitting) of the one or more first liquid feeds includes a flange.

Example 19 is the liquid-collecting arrangement according to any one of Examples 1 to 18, wherein at least one or each liquid feed (for example its feed fitting) of the one or more second liquid feeds includes a flange.

Example 20 is the liquid-collecting arrangement according to any one of Examples 1 to 19, furthermore including: an optional sensor (for example liquid sensor) for detecting the liquid (for example waste liquid), preferably for detecting the fill level of the liquid in the container (for example its amount and/or its level), wherein the optional sensor is arranged, for example, in the sensor opening (for example of the container) or extends through the sensor opening into the cavity; the liquid-collecting arrangement optionally furthermore including: an actuator, preferably including or produced from an opening element (for example opening/ closing element), for setting a pressure applied to the extraction fitting; wherein, for example, the actuator is coupled to the extraction fitting (for example fluidically).

Example 21 is the liquid-collecting arrangement according to Example 20, furthermore including: a sensor circuit configured to: detect the liquid (for example waste liquid) in the cavity by means of the sensor; output a sensor signal based on a result of detecting the liquid (for example waste liquid) in the cavity.

Example 22 is the liquid-collecting arrangement according to Example 20 or 21, furthermore including: a control device configured to actuate an actuator and/or a drive device (for example by means of a message according to a network communication protocol) based on a result of detecting the liquid (for example waste liquid) or based on the sensor signal and (for example optionally)/or based on a stored time interval (for example in the control device).

Example 23 is the liquid-collecting arrangement according to Example 22 the actuator including: the drive device, preferably comprising a solenoid (for example a magnetic coil or another solenoid valve drive device), and an extraction valve (for example a solenoid valve), wherein the drive device is configured, in response to the actuation, to close or open the extraction valve; wherein, for example, the extraction valve is coupled to the extraction fitting (for example fluidically).

Example 24 is the liquid-collecting arrangement according to Example 23, wherein the extraction valve is coupled to the extraction fitting and/or to a pump system (for example fluidically); and/or wherein the drive device and the extraction valve are arranged together in a housing (for example of a fitting).

Example 25 is the liquid-collecting arrangement according to any one of Examples 1 to 24, furthermore including: at least one fluid guiding device (for example one fluid guiding device per extraction fitting), by means of which the at least one extraction fitting is coupled to the cavity for guiding a fluid flow between the cavity and the at least one extraction fitting, wherein the fluid guiding device, for example, deflects and/or constricts a fluid flow from the cavity into the at least one extraction fitting once or more than once (for example out of or into a vertical direction).

Example 26 is the liquid-collecting arrangement according to any one of Examples 1 to 25, furthermore including: at least one overflow protection device (for example one overflow protection device per extraction fitting), by means of which the at least one extraction fitting is coupled to the cavity for inhibiting a (for example only gravitationally driven) fluid flow from the cavity into the at least one extraction fitting (for example when the same gas pressure prevails in the cavity and the at least one extraction fitting).

Example 27 is the liquid-collecting arrangement according to any one of Examples 1 to 26, furthermore including: at least one suction promoting device (for example one suction promoting device per extraction fitting), by means of which the at least one extraction fitting is coupled to the cavity to promote a (for example driven by negative pressure) fluid flow from the cavity into the at least one extraction fitting during the extraction (for example when the gas pressure in the cavity is different from the gas pressure in the at least one extraction fitting, for example when a greater gas pressure prevails in the at least one cavity than in the at least one extraction fitting).

Example 28 is a method for assembling a (for example above-ground) liquid-collecting arrangement (for example according to any one of Examples 1 to 27), wherein the method includes: coupling (for example fluidically) one or more than one first source of liquid (for example waste liquid) (also referred to as a first liquid source) to the one or more than one first liquid feeds (for example waste liquid feeds) (for example a feed fitting thereof); coupling (for example fluidically) one or more than one second source of liquid (for example waste liquid) (also referred to as a second liquid source) to the one or more than one second liquid feeds (for example waste liquid feeds) (for example a feed fitting thereof).

Example 29 is a method of operating a (for example above-around) liquid-collecting arrangement (for example waste liquid-collecting arrangement) (for example according to any one of Examples 1 to 27), the method including: collecting liquid (for example waste liquid) from a first device (for example first liquid source) coupled (for example fluidically) to the one or more than one first liquid feeds (for example, waste liquid feeds) (for example a feed fitting thereof) in the cavity; collecting liquid (for example waste liquid) from a second device (for example first liquid source) coupled (for example fluidically) to the one or more than one second liquid feeds (for example, waste liquid feeds) (for example a feed fitting thereof) in the cavity; extracting (for example pulsed and/or multiple extraction, for example at intervals) the liquid (for example waste liquid) from the cavity through the extraction fitting by means of a negative pressure applied to the extraction fitting.

Example 30 is a liquid drainage system (for example, waste liquid drainage system) including; at least one liquid-collecting arrangement (for example, waste liquid-collecting arrangement) (for example, according to any one of Examples 1 to 27); a pump system and a negative pressure line, wherein the negative pressure line couples the extraction fitting (for example by means of the extraction valve) of the liquid-collecting arrangement to the pump system (for example fluidically), wherein the pump system is configured to apply a negative pressure to the negative pressure line.

Example 31 is configured like any one of Examples 1 to 30, wherein the container, for example per liquid feed of the one or more first liquid feeds and/or the one or more second liquid feeds, includes an opening (for example container opening) which the receives the liquid feed or is coupled thereto (at which it opens into the cavity), of which, for example, adjacent openings (for example container openings) are at a distance from one another and/or correspond in their distance from a bottom of the container.

Example 32 is configured like any one of Examples 1 to 31, wherein each liquid feed of the one or more first liquid feeds is directed away from the one or more second liquid feeds; and/or wherein each liquid feed of the one or more second liquid feeds is directed away from the one or more first liquid feeds.

Example 33 is configured like any one of Examples 1 to 32, wherein the container is flatly shaped or has at least one height (for example dimension transverse to a direction directed from the first side to the second side and/or the dimension dimension from the bottom to the cover of the container) that is less than: a smallest dimension (for example width or length) of the container transverse to the height and/or than approximately 0.4 meters (for example approximately 0.3 m, for example approximately 0.2 m, for example approximately 0.1 m, for example approximately 0.05 m).

According to various embodiments, the collecting container can include multiple of inlet openings, for example distributed on opposite sides, for example 4 inlet openings per side of the collecting container.

According to various embodiments, there can be one blocking device per inlet opening of the collecting container, preferably including or produced from a valve or a stopper, to which the inlet opening is coupled (for example fluidically).

According to various embodiments, the collecting container can include a vertical vent pipe which is, for example, up to 0.5 meters long.

According to various embodiments, the collecting container can include multiple outlet openings, which are distributed, for example, on opposite sides and/or extend away from one another through a container wall.

According to various embodiments, the collecting container can include a sensor opening (also referred to as a detection opening) or a liquid sensor can be arranged in the sensor opening.

According to various embodiments, the collecting container can be coupled to one or more flexible hoses, each hose being coupled to an inlet opening of the collecting container and/or to a feed fitting (for example fluidically), and/or each hose having a length of up to 7 meters.

According to various embodiments, each flexible hose can be coupled to a flange for connection to a liquid source (for example fluidically).

According to various embodiments, the collecting container can include a flatly shaped housing.

The invention claimed is:

1. A liquid-collecting arrangement (151) including:

a container (102) having a cavity (102*h*) for collecting liquid;

at least one extraction fitting (104) coupled to the cavity (102*h*) for extracting liquid from the cavity (102*h*) by means of negative pressure;

one or more first liquid feeds (108) opening directly into the cavity (102*h*) on a first side (101*a*) of the container for feeding liquid into the cavity (102*h*);

one or more second liquid feeds (118) opening directly into the cavity (102*h*) on the first side or on a second side (101*b*) of the container for feeding liquid into the cavity (102*h*), wherein the first side (101*a*) is opposite to the second side (101*b*); and a pressure compensation fitting (704), connected to the one or more first liquid feeds (108) and to the one or more second liquid feeds (118) by means of the cavity (102*h*);

wherein teh at least one extraction fitting (104) opens laterally into the cavity (102*h*) at a height adjacent to the one or more first liquid feeds.

2. The liquid-collecting arrangement (151) according to claim 1, wherein the at least one extraction fitting (104) includes multiple extraction fittings which are coupled to one another by means of the cavity (102*h*).

3. The liquid-collecting arrangement (151) according to claim 1, wherein at least one liquid feed of the one or more first liquid feeds (108) and/or the one or more second liquid feeds (118) includes a feed fitting, which is coupled to the cavity (102*h*).

4. The liquid-collecting arrangement (151) according to claim 3, wherein the at least one liquid feed furthermore includes a flexible hose coupling the feed fitting to the container (102).

5. The liquid-collecting arrangement (151) according to claim 4, wherein the hose has a length which is greater than a distance of the one or more first liquid feeds (108) from the one or more second liquid feeds (118).

6. The liquid-collecting arrangement (151) according to claim 4, wherein the at least one liquid feed furthermore includes a blocking device, including a valve or a plug, coupling the feed fitting to the container (102).

7. The liquid-collecting arrangement (151) according to claim 1, including the pressure compensation fitting (704)

wherein the pressure compensation fitting (704) is connected to the at least one extraction fitting (104) by means of the cavity (102*h*).

8. The liquid-collecting arrangement (151) according to claim 7, furthermore including:

a pressure compensation device, including a hose or a tube, which is coupled to the cavity (102*h*) by means of the pressure compensation fitting.

9. The liquid-collecting arrangement (151) according to claim 1, wherein the multiple first liquid feeds (108) include four or more liquid feeds.

10. The liquid-collecting arrangement (151) according to claim 1, wherein the multiple second liquid feeds (118) include four or more liquid feeds.

11. The liquid-collecting arrangement (151) according to claim 1, furthermore including:

an actuator (1302), an opening element, for setting a pressure applied at the extraction fitting (104); and a control device (1002), which is configured to control the actuator (1302) based on a stored time interval and/or based on a result of detecting the liquid (902), its fill level, in the container by means of a sensor (902) of the liquid-collecting arrangement (151).

12. The liquid-collecting arrangement (151) according to claim 11, the actuator (1302) including:

a drive device (1004), including a solenoid, and an extraction valve (1104), wherein the drive device (1004) is configured to close or open the extraction valve (1104) in response to the actuation.

13. A method (1900) for assembling the liquid-collecting arrangement (151) according to claim 1, the method including:

coupling (1901) a first source of liquid to the one or more first liquid feeds (108);

coupling (1903) a second source of liquid to the one or more second liquid feeds (118).

14. A method (2000) for operating the liquid-collecting arrangement (151) according to claim 1, the method including:

collecting (2001) liquid from a first device, which is coupled to the one or the multiple first liquid feeds (108), in the cavity (102*h*);

collecting (2003) liquid from a second device, which is coupled to the one or the multiple second liquid feeds (118), in the cavity (102*h*);

extracting (2005) the liquid from the cavity (102*h*) through the extraction fitting (104) by means of a negative pressure applied to the extraction fitting (104).

15. A liquid drainage system (153) including;

at least one liquid-collecting arrangement (151) according to claim 1;

a pump system (1202) and a negative pressure line (1120) which couples the extraction fitting (104) of the liquid collecting arrangement (151) to the pump system (1202), wherein the pump system (1202) is configured to apply a negative pressure to the negative pressure line (1120).

16. The liquid-collecting arrangement (151) according to claim 1, wherein the at least one extraction fitting (104) opens into a fluid guiding device (1450) which includes an overflow protection device (1440) and/or a suction protection device (1442), wherein the fluid guiding device (1450) is configured to guide a fluid exchange path (1411) along which fluid reaches the at least one extraction fitting (104), wherein the overflow protection device (1440) includes a first wall that protrudes into the container (102) from below, and wherein the suction protection device (1442) is configured to block a gas exchange through the overflow protection device (1440) and includes a second wall that protrudes into the container (102) from above.

* * * * *